US010155410B2

(12) United States Patent
Nakamura et al.

(10) Patent No.: US 10,155,410 B2
(45) Date of Patent: Dec. 18, 2018

(54) BALLPOINT PEN CHIP AND WRITING UTENSIL EQUIPPED WITH THE BALLPOINT PEN CHIP

(71) Applicant: ZEBRA CO., LTD., Tokyo (JP)

(72) Inventors: Naoko Nakamura, Tokyo (JP); Toshiaki Tsuchiya, Saitama (JP)

(73) Assignee: ZEBRA CO., LTD., Tokyo (JP)

( * ) Notice: Subject to any disclaimer, the term of this patent is extended or adjusted under 35 U.S.C. 154(b) by 142 days.

(21) Appl. No.: 15/340,219

(22) Filed: Nov. 1, 2016

(65) Prior Publication Data

US 2017/0151823 A1 Jun. 1, 2017

(30) Foreign Application Priority Data

Dec. 1, 2015 (JP) ..... 2015-234594
Jun. 9, 2016 (JP) ..... 2016-115657

(51) Int. Cl.
*B43K 7/10* (2006.01)
*B43K 1/08* (2006.01)

(52) U.S. Cl.
CPC ..... *B43K 7/10* (2013.01); *B43K 1/084* (2013.01); *B43K 1/086* (2013.01)

(58) Field of Classification Search
None
See application file for complete search history.

(56) References Cited

U.S. PATENT DOCUMENTS 5,810,495 A * 9/1998 McAuley ..... A45D 34/041 401/213
6,193,429 B1 * 2/2001 Kim ..... B43K 1/086 401/214
6,299,375 B1 10/2001 Abe
8,591,133 B2 * 11/2013 Ho ..... A45D 34/041 401/209

FOREIGN PATENT DOCUMENTS

JP 2004-001246 1/2004
JP 2013-252654 12/2013
JP 2016-163935 9/2016

* cited by examiner

*Primary Examiner* — David Walczak
(74) *Attorney, Agent, or Firm* — Greenblum & Bernstein, P.L.C.

(57) ABSTRACT

To make it possible to easily change a writing line width. A ballpoint pen chip that brings a front half part side of a transfer ball into contact with an inward annular protrusion on a front end side in a chip body from a backward side of the inward annular protrusion and receives a rear half part side of the transfer ball with a front end part of a receiving member. The receiving member includes, on a front end side thereof, a reduction part gradually reduced in a cross-sectional area forward. A front-most end part of the reduction part is disposed backward from the transfer ball. A portion of the receiving member further on a rear side than the reduction part is unretreatably fixed to the chip body and configured to elastically contract when a pressing force is received from the transfer ball.

20 Claims, 21 Drawing Sheets

32
31
32

32a
32
31
30

32
32

BALLPOINT PEN CHIP AND WRITING UTENSIL EQUIPPED WITH THE BALLPOINT PEN CHIP

BACKGROUND OF THE INVENTION

Technical Field

The present invention relates to a ballpoint pen chip that changes the width of a writing line, and to a writing utensil equipped with the ballpoint pen chip.

Related Art

As a writing utensil of this type, there has been a writing utensil that adjusts a relative position of a bar stretching member that receives a ball from a backward side, as described in Japanese Patent Application Laid-Open No. 2004-1246, for example. With this writing utensil, if the relative position of the bar stretching member is changed by adjusting a screw-in amount of the chip or the bar stretching member, or by adjusting a rotation amount of a movement control member, and the like, then a gap between the ball and a butt end inner edge part of the chip changes, which also leads to a change in an ink ejection amount. As a result, the width of the writing line also changes.

As another conventional technique, there is a technique for changing a line width by adjusting an inclination angle of a chip with respect to a written surface (see Japanese Patent Application Laid-Open No. 2013-252654).

SUMMARY OF THE INVENTION

In the conventional technique of Japanese Patent Application Laid-Open No. 2004-1246, however, it is necessary to adjust the relative position of the bar stretching member in order to change the width of the writing line, and operation for this adjustment is time consuming and troublesome. In the conventional technique of Japanese Patent Application Laid-Open No. 2013-252654, on the other hand, a writing posture sometimes loses its balance due to a change in the inclination angle of the writing utensil.

In view of such problems, the present invention includes the following configuration.

A ballpoint pen chip including: a substantially cylindrical chip body having an inner part pierced through in a front-rear direction; a transfer ball housed on a front end side in the chip body, an outer peripheral surface front end side of the transfer ball being protruded forward from the chip body; and a receiving member disposed further on a backward side than the transfer ball in the chip body, a rear half part side of the transfer ball being received by a front end part of the receiving member. The receiving member includes, on a front end side thereof, a reduction part gradually reduced in a cross-sectional area forward. A front-most end part of the reduction part is disposed backward from the transfer ball. A portion of the receiving member further on a rear side than the reduction part is unretreatably fixed to the chip body and configured to elastically contract when a pressing force is received from the transfer ball.

Since the present invention is configured as explained above, it is possible to easily change a writing line width.

BRIEF DESCRIPTION OF THE DRAWINGS

FIGS. 2A to 2C show an example of a receiving member, wherein FIG. 2A is a front view, FIG. 2B is a half sectional view, and FIG. 2C is a rear view;

FIGS. 21A and 21B are sectional views taken along line (XXI)-(XXI) in FIG. 20, wherein FIG. 21A shows a normal state and FIG. 21B shows a state in which a reduction part deflecting in a radial direction is received by a deflection suppressing protrusion.

DESCRIPTION OF THE PREFERRED EMBODIMENTS

A first characteristic of an embodiment is a ballpoint pen chip including: a substantially cylindrical chip body having an inner part pierced through in a front-rear direction; a transfer ball housed on a front end side in the chip body, an outer peripheral surface front end side of the transfer ball being protruded forward from the chip body; and a receiving member disposed further on a backward side than the transfer ball in the chip body, a rear half part side of the transfer ball being received by a front end part of the receiving member. The receiving member includes, on a front end side thereof, a reduction part gradually reduced in a cross-sectional area forward. A front-most end part of the reduction part is disposed backward from the transfer ball. A portion of the receiving member further on a rear side than the reduction part is unretreatably fixed to the chip body and configured to elastically contract when a pressing force is received from the transfer ball.

With the configuration, it is possible to prevent, with the reduction part, the front end side of the receiving member from deflecting in a radial direction and to stably obtain a writing line having a thickness corresponding to a pressing force.

Note that the "reduction part" does not include a coil spring.

As a second characteristic, in order to more effectively suppress the front end side of the receiving member from deflecting in the radial direction, the reduction part is formed to be solid and shaped such that the cross-sectional area of the reduction part is continuously enlarged backward from the front-most end part of the receiving member.

The expression "formed to be solid" means a state of not including a hollow part in an inner part.

Specific examples of the reduction part include a form of a truncated cone shape and a form of a truncated pyramid shape.

As a third characteristic, in order to realize a form in which an ink flow passage can be sufficiently secured in the chip body and manufacturability is satisfactory, the receiving member includes, further on a rear side than the reduction part, a plurality of supporting protrusions which protrude in a radial outer direction at intervals in a circumferential direction. The supporting protrusions are pressure-welded to an inner wall surface of the chip body so as to be unretreatably fixed thereto.

Figure 1:
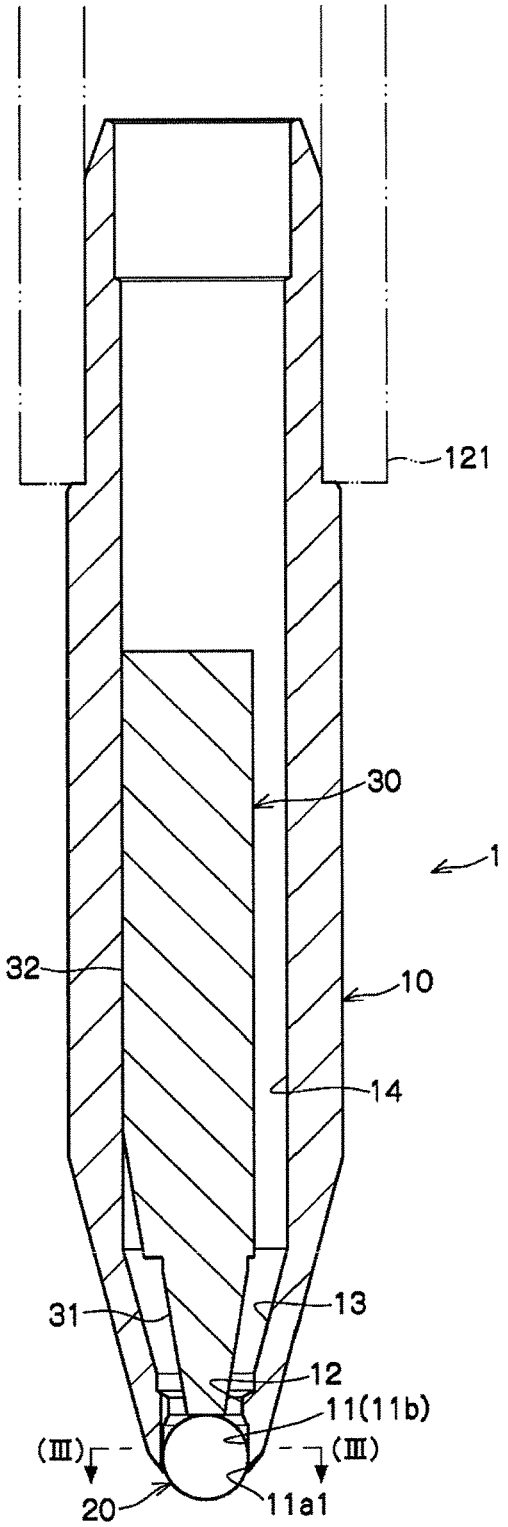
FIG. 1 is a longitudinal sectional view showing a first embodiment of a ballpoint pen chip according to the present invention.
Figure 9:
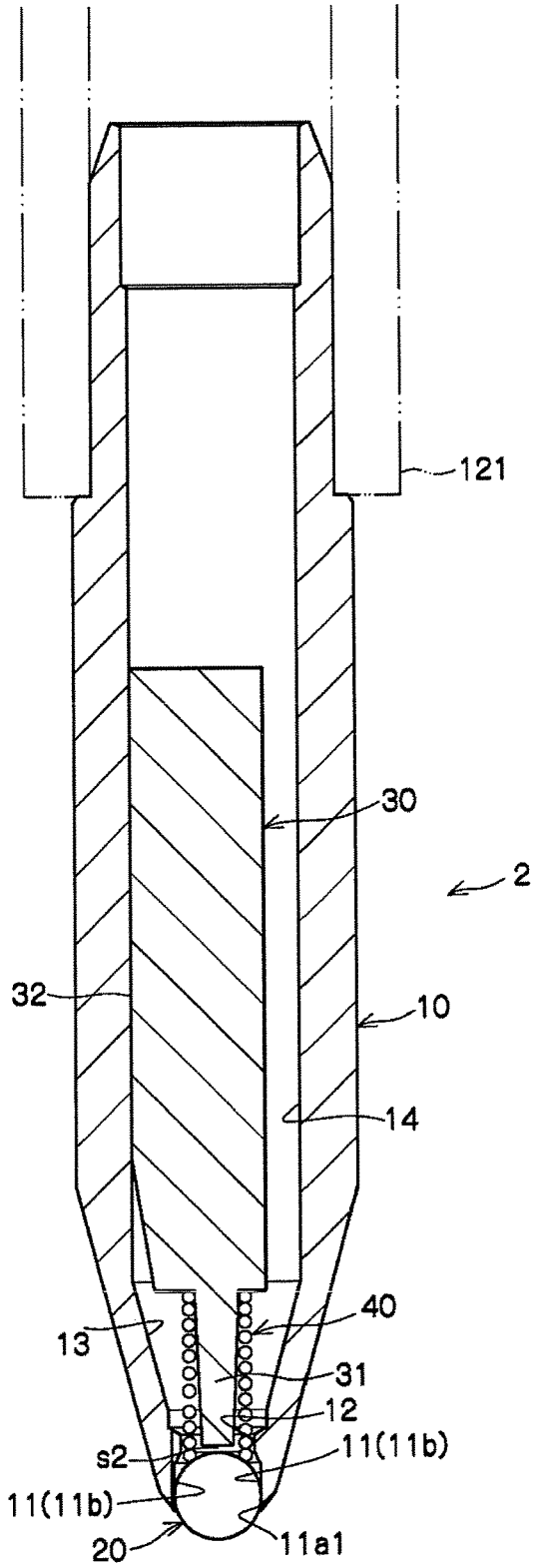
FIG. 9 is a longitudinal sectional view showing a second embodiment of the ballpoint pen chip according to the present invention.

As a fourth characteristic, the receiving member is integrally formed from one kind of a synthetic resin material such that a soft writing feeling is obtained (see FIGS. 1 and 9).

Figure 10:
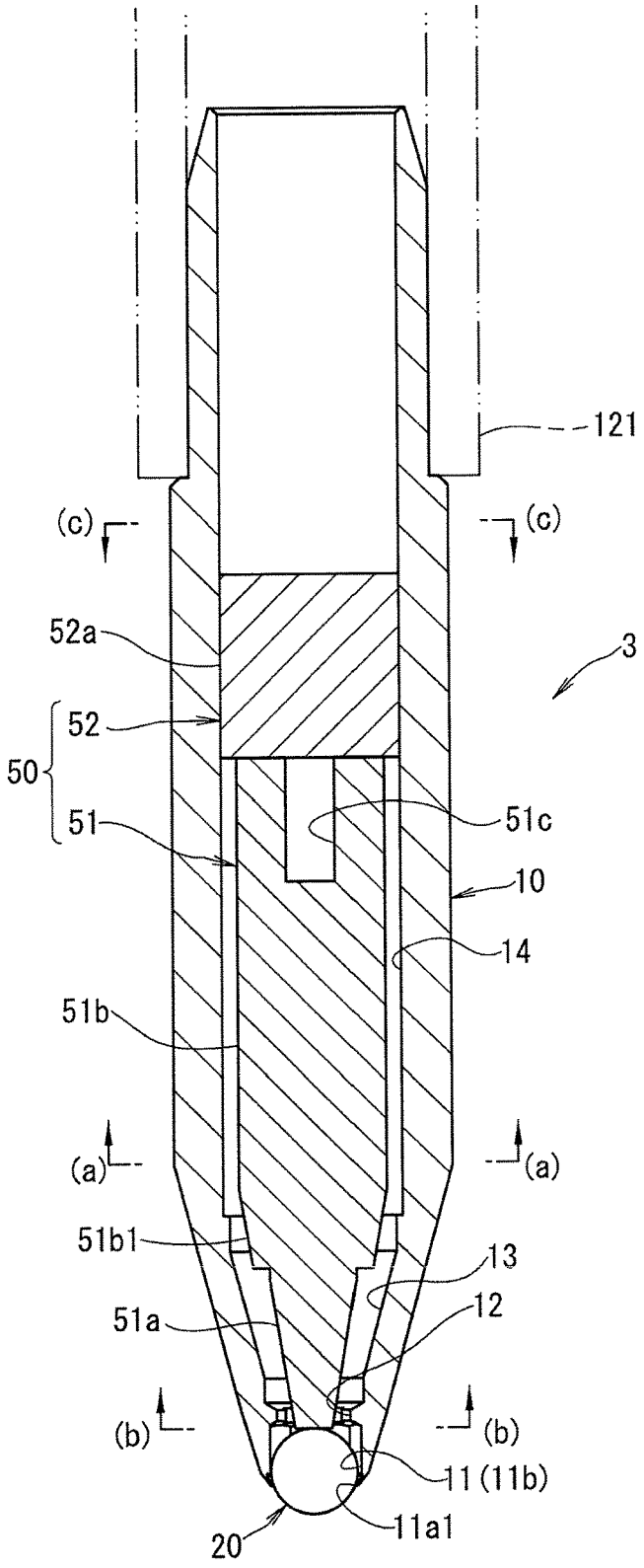
FIG. 10 is a longitudinal sectional view showing a third embodiment of the ballpoint pen chip according to the present invention.
Figure 15:
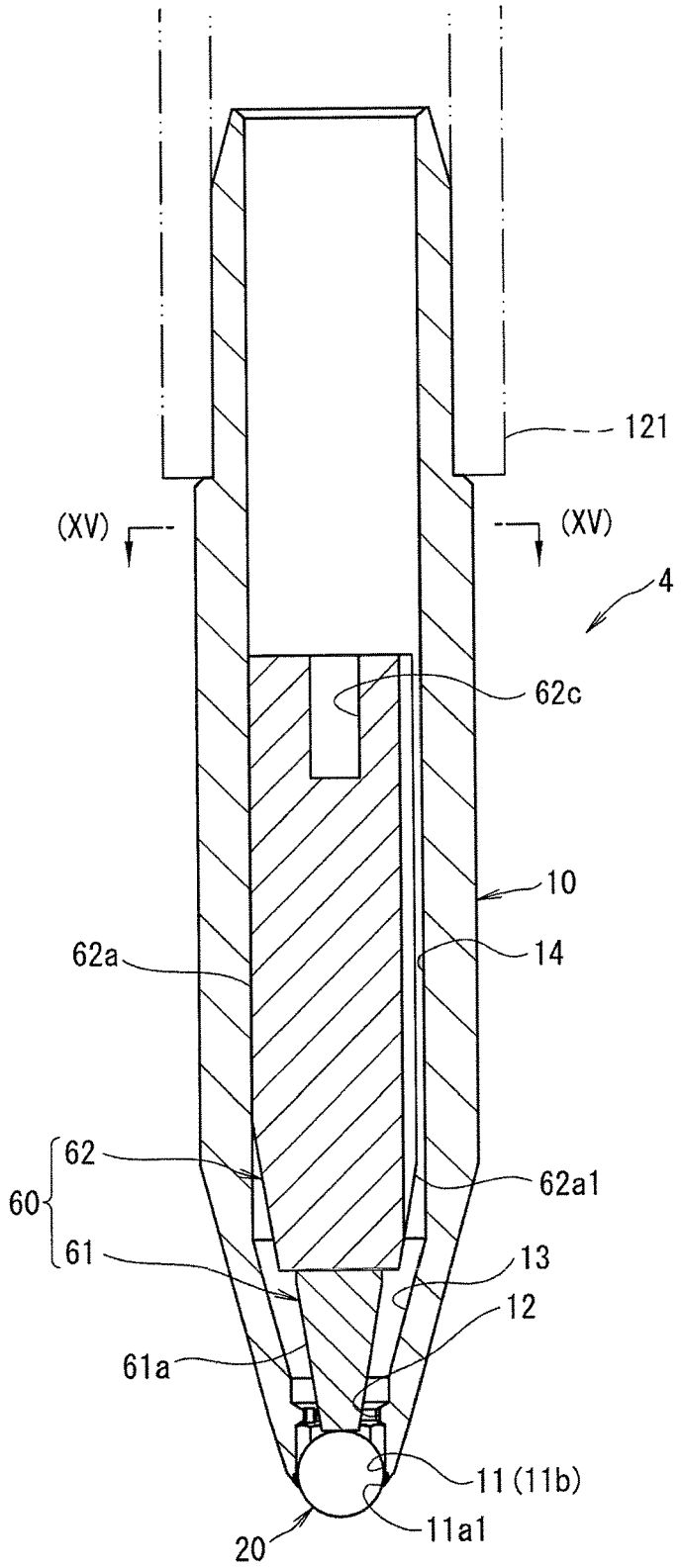
FIG. 15 is a longitudinal sectional view showing a fourth embodiment of the ballpoint pen chip according to the present invention.
Figure 16:
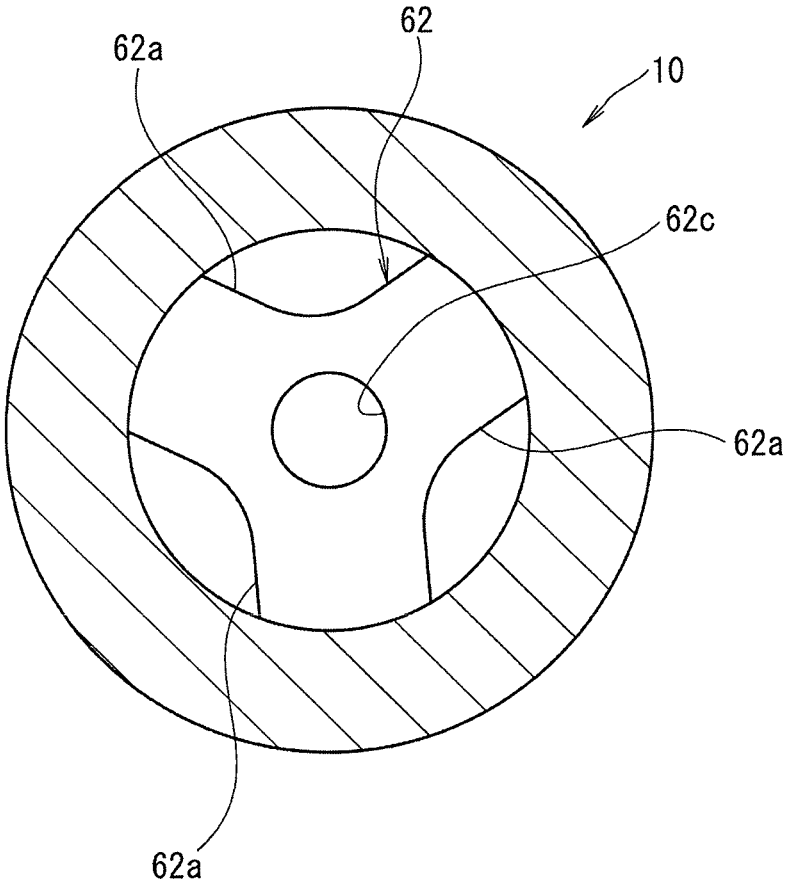
FIG. 16 is a sectional view taken along line (XV)-(XV) in FIG. 15.
Figure 17:
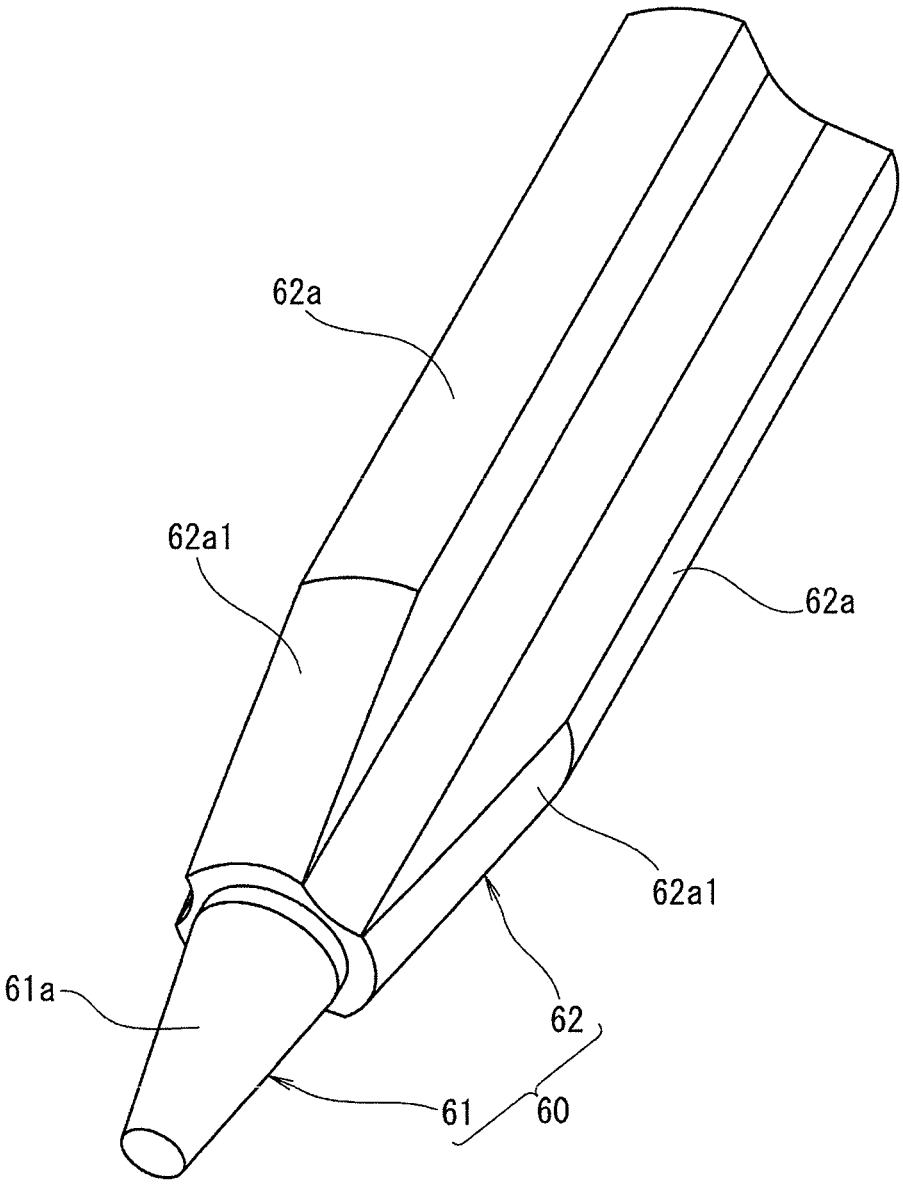
FIG. 17 is a perspective view showing a receiving member in the fourth embodiment.

As a fifth characteristic, in order to efficiently elastically deform the receiving member and improve productivity, the receiving member is configured from two members, that is, a front side member including the reduction part and a rear side member including the supporting protrusions (see FIGS. 10 and 15).

As a sixth characteristic, in order to improve quality and productivity, the rear side member is formed of a material having wear resistance higher than the wear resistance of the front side member.

As a seventh characteristic, in order to effectively elastically deform the receiving member and facilitate line width adjustment, the front side member is formed of a material that is more easily deformed elastically than the rear side member.

As an eighth characteristic, in order to more effectively elastically deform the receiving member and improve productivity, the front side member is provided between the transfer ball and the rear side member in a state in which the front side member is loosely fit on an inner peripheral surface of the chip body.

As a ninth characteristic, in order to reduce flowing resistance of ink in the chip body, in the front side member, a plurality of longitudinal ribs extending in the front-rear direction are provided at intervals in a circumferential direction in an outer peripheral part further on a rear side than the reduction part. The number of the longitudinal ribs and the number of the supporting protrusions are different (see FIG. 12).

As a tenth characteristic, as a preferred form in which productivity is satisfactory, the front side member and the rear side member are coupled and integrated (see FIG. 15).

As an eleventh characteristic, in order to prevent the reduction part from deflecting in a radial outer direction, a deflection suppressing protrusion that suppresses deflection of the reduction part while being in proximity or in contact with a sidewall of the reduction part is provided on an inner wall of the chip body (see FIGS. 18 to 21B).

Figure 19:
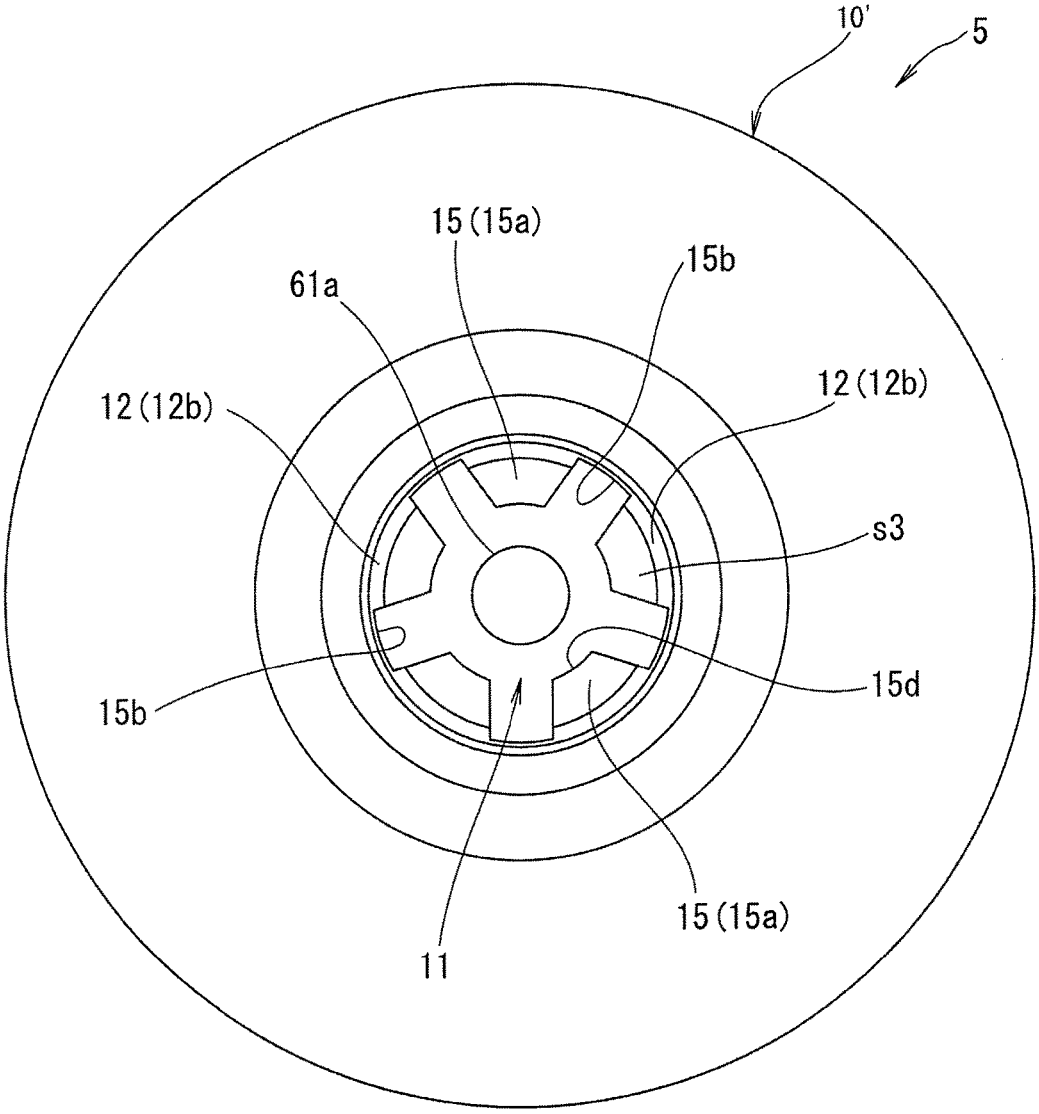
FIG. 19 is a front enlarged view excluding a transfer ball in the fifth embodiment.
Figure 20:
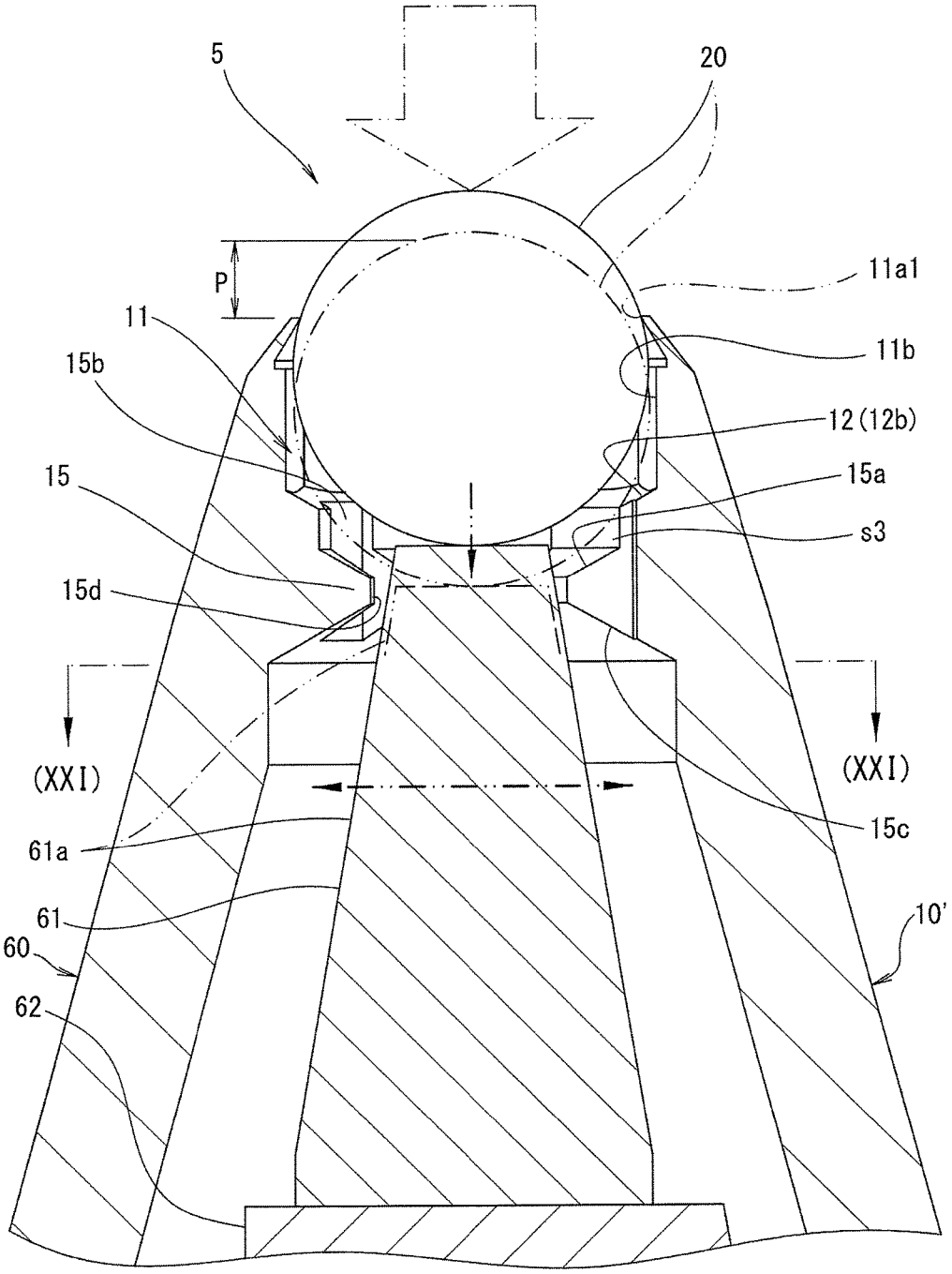
FIG. 20 is a main part enlarged view in the fifth embodiment.

As a twelfth characteristic, in order to stabilize an ink flow rate, a plurality of the deflection suppressing protrusions are provided at intervals in the circumferential direction, and respective spaces between the deflection suppressing protrusions adjacent to each other in the circumferential direction constitute an ink guide groove communicating in the front-rear direction (see FIGS. 19 and 20).

As a thirteenth characteristic, in order to further stabilize the ink flow rate, a constricted part that receives the transfer ball on a front end surface when the transfer ball retreats is provided on a front end side in the chip body, and the deflection suppressing protrusion is disposed further on a backward side than the front end surface of the constricted part.

As a fourteenth characteristic, front and rear positions of the constricted part are set such that the received transfer ball protrudes forward from a front end of the chip body (see FIG. 20).

As a fifteenth characteristic, in order to effectively prevent, in particular, an ink leak, a coil spring is disposed annularly around the reduction part, and a front end part of the coil spring is brought in contact with the transfer ball and a rear end part of the coil spring is unretreatably supported (see FIG. 9).

Figure 3:
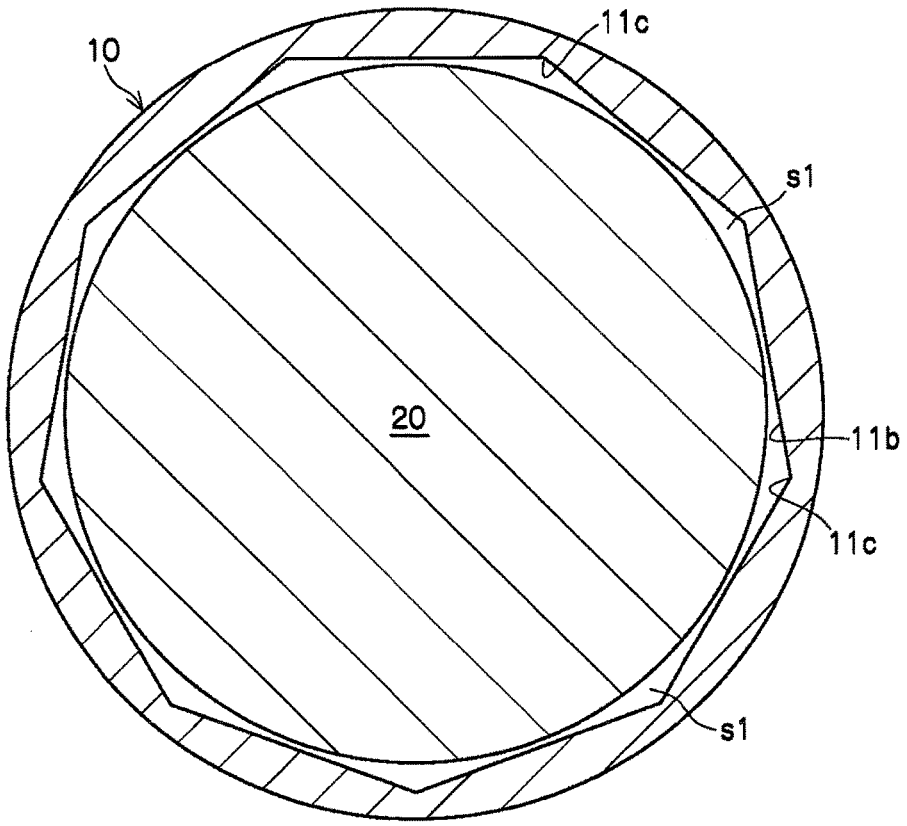
FIG. 3 is a sectional view taken along line (III)-(III) in FIG. 1.

As a sixteenth characteristic, in order to sufficiently secure an ink flow path in the chip body and improve quality and productivity, a rectangular cylindrical inner wall surface is formed on a front end side in the chip body, and the rectangular cylindrical inner wall surface is in proximity or in contact with an outer peripheral surface of the transfer ball (see FIG. 3).

Figure 7:
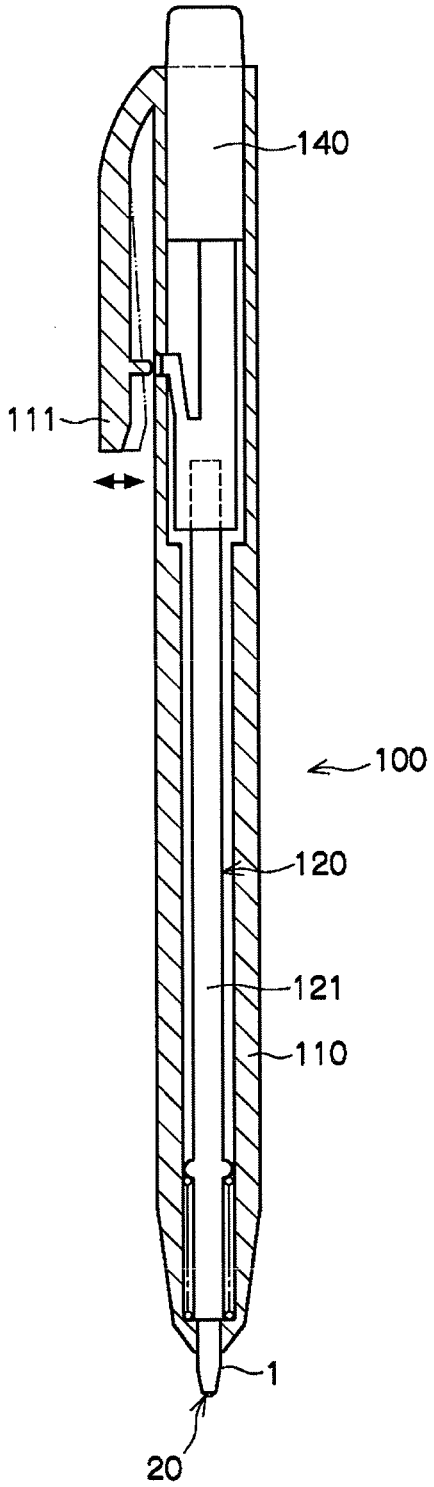
FIG. 7 is a longitudinal sectional view of a writing utensil equipped with the ballpoint pen chip according to the present invention.

As a seventeenth characteristic, a writing utensil is configured to include the ballpoint pen chip (see FIG. 7).

Specific embodiments having the characteristics are explained in detail with reference to the drawings.

Note that, in this specification, "forward" means a distal end direction of a ballpoint pen chip and "backward" means the opposite direction of the distal end direction. A "radial outer direction" means a direction separating from a center part in a radial direction of the ballpoint pen chip and a "radial inner direction" means the opposite direction of the radial outer direction.

First Embodiment

FIG. 1 shows a ballpoint pen chip 1 according to the present invention.

The ballpoint pen chip 1 includes a substantially cylindrical chip body 10 having an inner part pierced through in the front-rear direction, a transfer ball 20 housed on the front end side in the chip body 10, the outer peripheral surface front end side of the transfer ball 20 being protruded forward from the front end of the chip body 10, and a receiving member 30 disposed further on the backward side than the transfer ball 20 in the chip body 10.

In the ballpoint pen chip 1, the front half part side of the transfer ball 20 is brought in contact with an inward annular protrusion 11*a*1 on a front end side in the chip body 10, from the backward side of the annular protrusion 11*a*1. The rear half part side of the transfer ball 20 is received by a front end part of the substantially bar-like receiving member 30 without being received by the inner surface of the chip body 10 in an initial state.

In the ballpoint pen chip 1, an inner wall surface on the front end side of the chip body 10 is formed in a rectangular cylindrical shape. The outer peripheral surface of the transfer ball 20 is in proximity or in contact with a rectangular cylindrical inner wall surface 11*b*.

The chip body 10 is formed in a substantially cylindrical shape having a tapered conical portion on a front end side from, for example, stainless steel, an alloy such as brass or nickel silver, or synthetic resin.

In the chip body 10, a ball house 11, a constricted part 12, a constricted tip hole 13, and a large diameter hole 14 are provided in order from the front end part side. Internal spaces of these parts communicate with one another in the front-rear direction.

In the ball house 11, a space for rotatably housing the transfer ball 20 is configured by the inward annular protrusion 11*a*1 close to a front-most end, a rectangular cylindrical inner wall surface 11*b* extending backward from the inward annular protrusion 11*a*1, and the front end surface of the constricted part 12.

The inward annular protrusion 11*a*1 is formed by inserting the transfer ball 20 into the ball house 11 and thereafter caulking the front end part of the chip body 10 from the outside.

Figure 4:
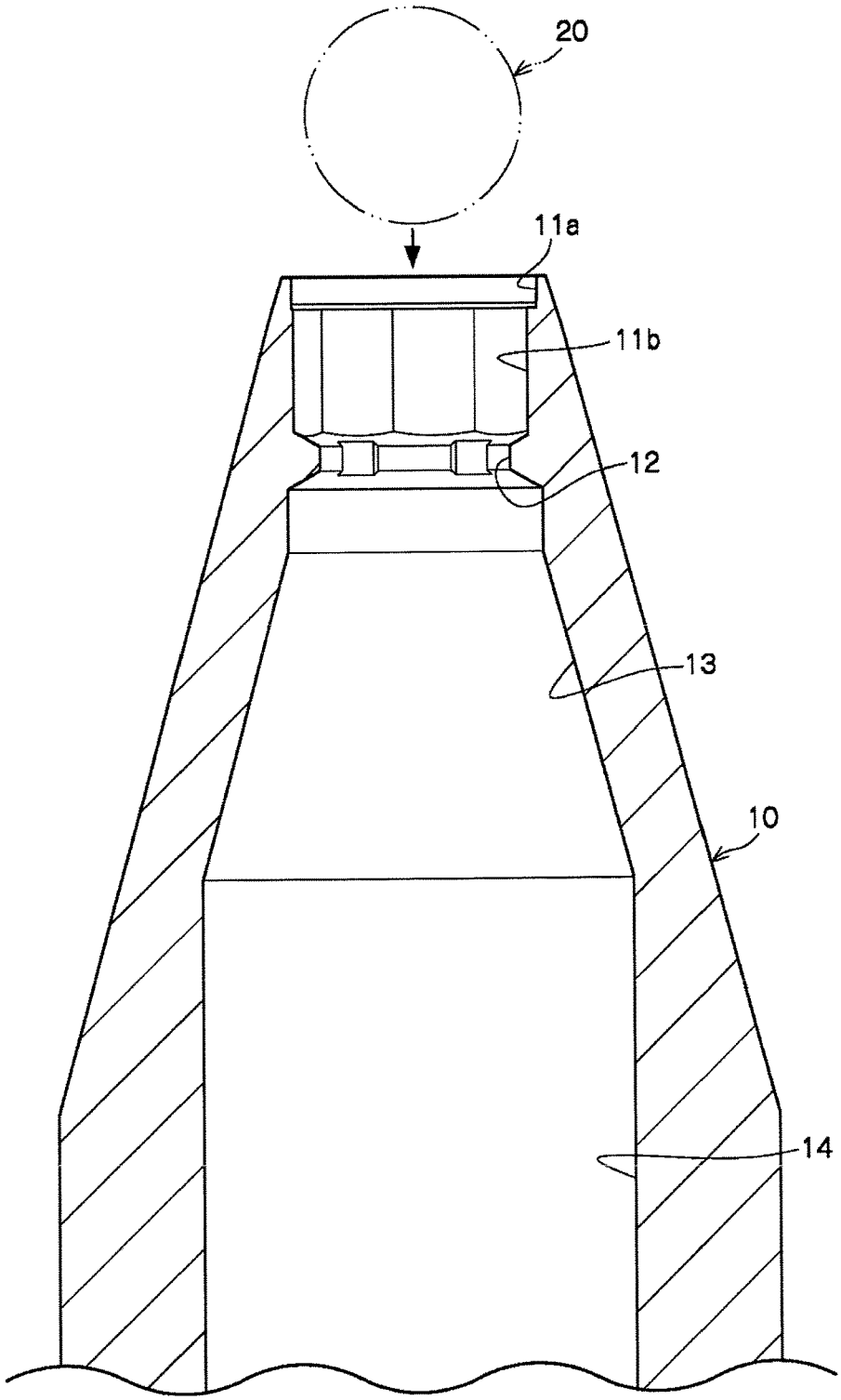
FIG. 4 is a main part longitudinal sectional view of a chip body in a state in which a distal end portion is not caulked.

That is, in a stage before the transfer ball 20 is inserted, as shown in FIG. 4, a cylindrical inner peripheral surface 11*a* is formed close to the front-most end of the ball house 11. After the transfer ball 20 is inserted into the ball house 11, a peripheral wall of the cylindrical inner peripheral surface 11*a* is caulked from the outside, whereby the inward annular protrusion 11*a*1 is formed on the front end side of the cylindrical inner peripheral surface 11*a*. The inward annular protrusion 11*a*1 protrudes in a radial inner direction from the cylindrical inner peripheral surface 11*a* and comes into contact with a front half part of the transfer ball 20.

The rectangular cylindrical inner wall surface 11*b* is an inner wall surface having a regular polygonal cylindrical shape (in an illustrated example, a regular nonagonal cylindrical shape). Surfaces configuring the rectangular cylindrical inner wall surface 11*b* are formed in a flat surface shape. Internal corner portions 11*c* are formed among surfaces adjacent to one another in the circumferential direction among a plurality of surfaces configuring the rectangular cylindrical inner wall surface 11*b*.

Figure 5:
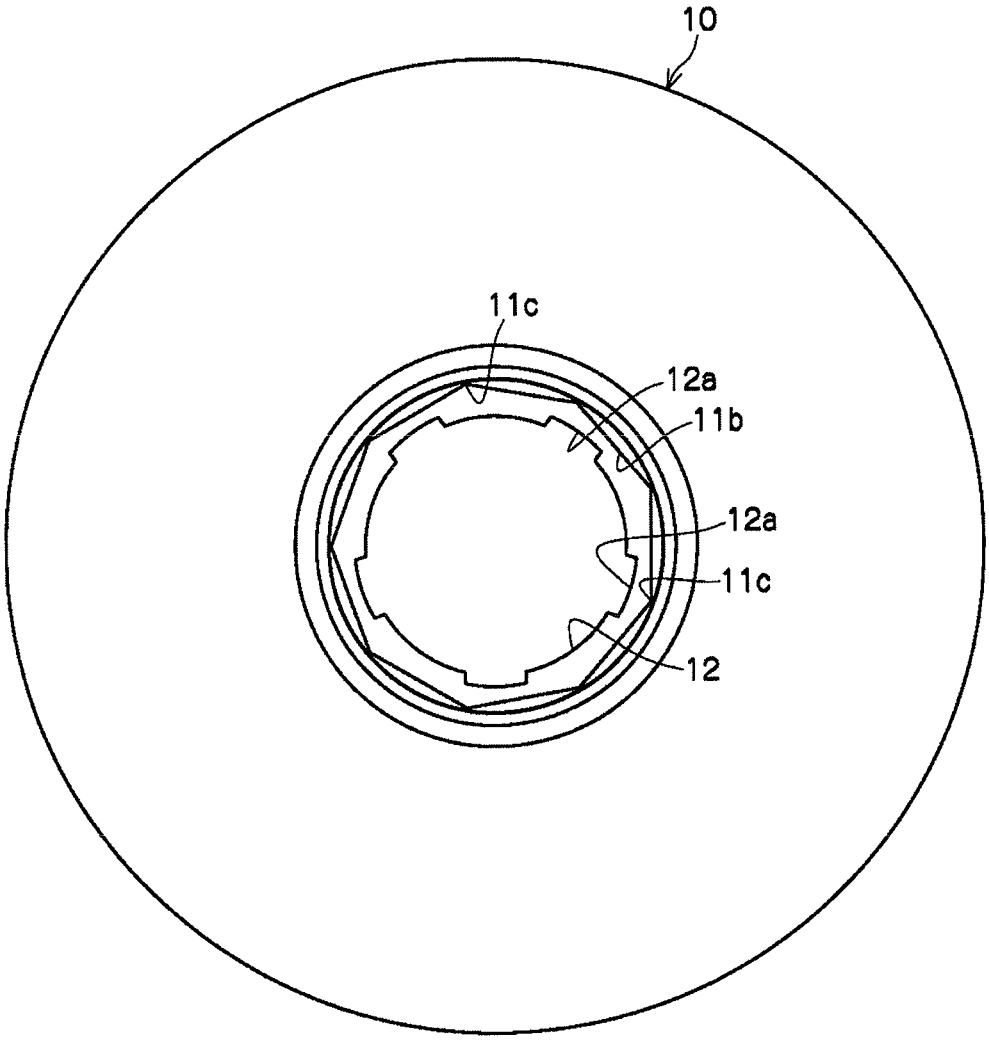
FIG. 5 is a front view of the chip body in the state in which the distal end portion is not caulked.
Figure 6:
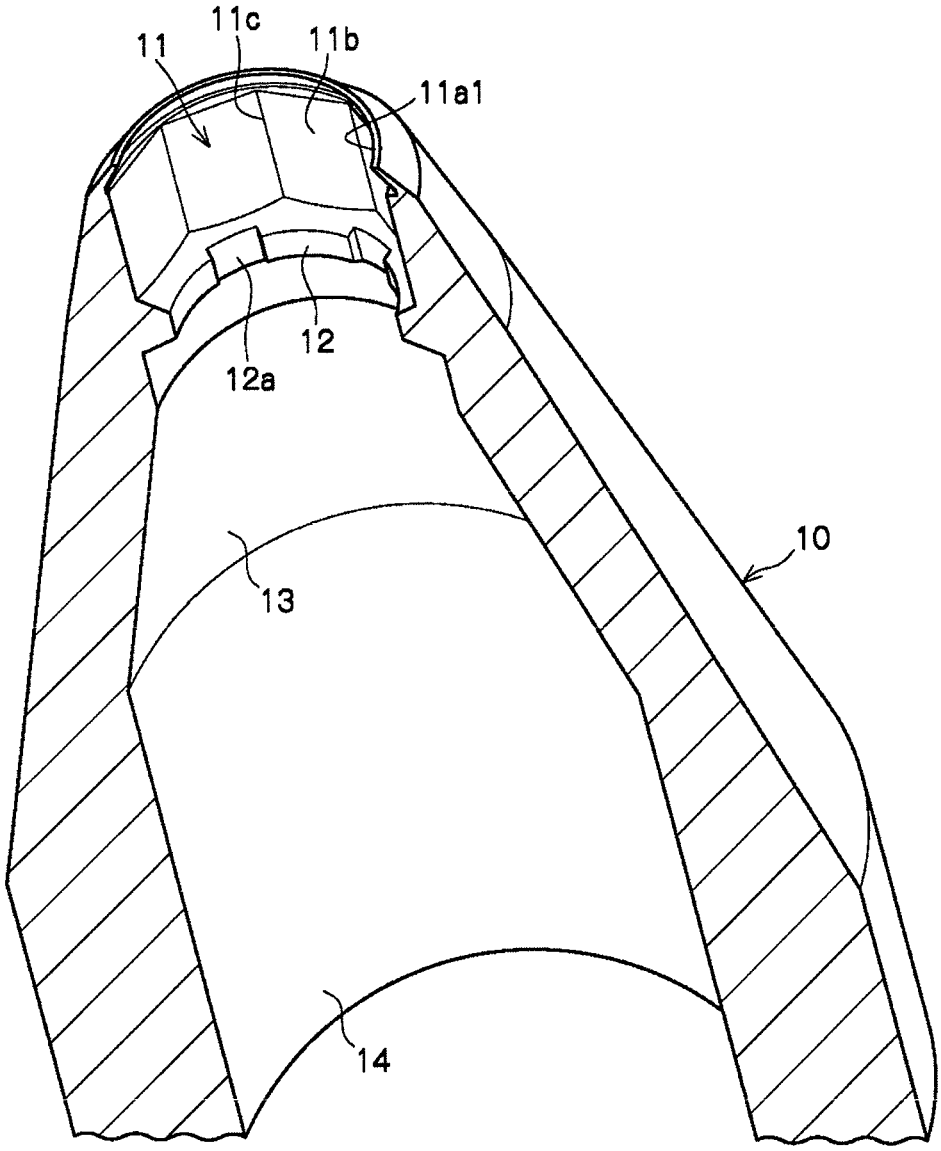
FIG. 6 is a perspective view showing a main part longitudinal cross section of the chip body in the state in which the distal end portion is not caulked.

The constricted part 12 is a portion formed in a substantially constricted shape (or an annular protrusion shape protruding in the radial inner direction) by reducing a portion further on the rear side than the rectangular cylindrical inner wall surface 11*b* to an inner diameter smaller than a minimum diameter of the rectangular cylindrical inner wall surface 11*b* (see FIGS. 1 and 4). The inner peripheral surface of a hole piercing through the constricted part 12 is a substantially cylindrical surface. Ink guide grooves 12*a* (see FIG. 5) piercing in the front-rear direction are formed in the surface. A flow cross-sectional area of the ink guide grooves 12*a* are set to properly secure an ink flow rate.

The constricted part 12 in the configuration is set to an inner diameter smaller than the outer diameter of the transfer ball 20 not to allow the transfer ball 20 to be inserted through backward.

Note that, as another example other than the illustrated example, it is also possible to adopt a shape in which the constricted part 12 is omitted and the rectangular cylindrical inner wall surface 11*b* is connected to the front end side of the constricted tip hole 13.

The constricted tip hole 13 is provided on the backward side of the constricted part 12.

The constricted tip hole 13 is a substantially truncated cone shape continuously reduced in diameter forward. The constricted tip hole 13 houses a reduction part 31 of the receiving member 30 explained below. A space around the reduction part 31 is formed as an ink flow path. A large diameter hole 14 continues on the rear end side of the constricted tip hole 13.

The large diameter hole 14 is formed in a substantially cylindrical shape continuing backward from the rear end of the constricted tip hole 13. The receiving member 30 is inserted into the large diameter hole 14. A plurality of supporting protrusions 32 on the rear part side of the receiving member 30 are pressure-welded and fixed to the inner wall surface of the large diameter hole 14.

The large diameter hole 14 is formed by forming a hole reduced in diameter stepwise forward using a plurality of drills reduced in diameter stepwise and thereafter machining the hole into a hole having the same diameter continuing in the front-rear direction with finishing such as reamer machining. Note that, as another example other than the illustrated example, the large diameter hole 14 can also be formed as a hole reduced in diameter stepwise forward by omitting the finishing.

The transfer ball 20 is formed in a spherical shape from a hard metal material such as a sintered body containing, for example, tungsten carbide or silicon carbide as a main component or a synthetic resin material. The transfer ball 20 is housed in the ball house 11.

The front half part side of the transfer ball 20 is pressed against the inward annular protrusion 11*a*1 on the front end side in the ball house 11. The rear half part side of the transfer ball 20 is not received by the front end surface of the constricted part 12, which is the inner surface of the chip body 10, and is received by only the front end surface of the receiving member 30. That is, a gap is secured between the front end surface of the constricted part 12 and the rear half part side of the transfer ball 20 (see FIG. 1). The front end surface of the receiving member 30 is in contact with the rear end surface of the transfer ball 20.

Figure 8:
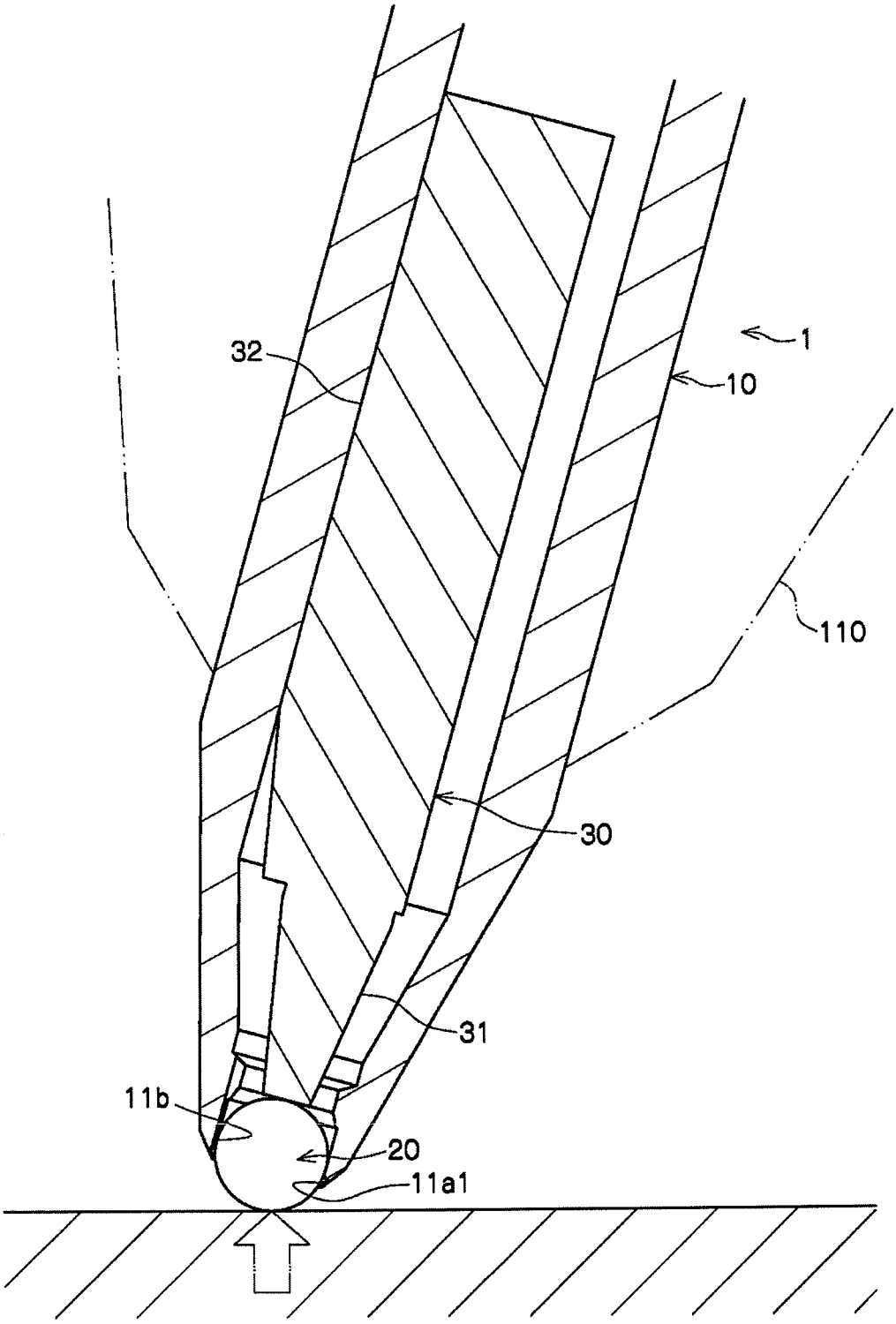
FIG. 8 is a main part sectional view showing a state of use of the writing utensil.

Note that, when writing is performed at a normal writing pressure, the transfer ball 20 maintains a state in which the transfer ball 20 is not received by the inner surface of the chip body 10 and is received by the front end part of the substantially bar-like receiving member 30 (see FIG. 8). However, when a backward strong pressing force is received because, for example, a writing pressure is too strong, the transfer ball 20 could be sometimes in contact with the constricted part 12 of the inner surface of the chip body 10.

The outer diameter of the transfer ball 20 is set to a diameter slightly smaller than an imaginary sphere that is in contact with the rectangular cylindrical inner wall surface 11*b* of the ball house 11. Therefore, the outer peripheral surface of the transfer ball 20 is in proximity with surfaces configuring the rectangular cylindrical inner wall surface 11*b* (see FIG. 3).

Note that the transfer ball 20 is sometimes slightly eccentric with respect to the center of the chip body 10 because of, for example, fluctuation in dimension accuracy of the inner surface of the ball house 11. In such a case, the outer peripheral surface of the transfer ball 20 is sometimes in contact with the surfaces configuring the rectangular cylindrical inner wall surface 11*b*.

As shown in FIG. 3, around the transfer ball 20, the internal corner portions 11*c* are formed among the flat surface parts adjacent to one another of the rectangular cylindrical inner wall surface 11*b*. The internal corner portions 11*c* secure a gap s1 functioning as an ink flow path.

The receiving member 30 includes a reduction part 31, a cross-sectional area of which is gradually reduced forward, on the front end side of the receiving member 30. A front-most end part of the reduction part 31 is disposed backward from the transfer ball 20. The receiving member 30 includes, further on the rear side than the reduction part 31, a plurality of (in an illustrated example, three) supporting protrusions 32 that protrude in the radial outer direction at intervals in the circumferential direction. The receiving member 30 is fixed to be incapable of advancing and retreating by pressure-welding the supporting protrusions 32 to the inner wall surface of the chip body 10.

The receiving member 30 is formed in an integral bar shape from an elastically deformable one kind of hard synthetic resin material such as polyacetal (POM), polyethylene (PE), or polypropylene (PP). The receiving member 30 elastically contracts with a pressing force received from the transfer ball 20.

The reduction part 31 is formed in a truncated cone shape, the outer diameter of which is continuously enlarged backward from a contact surface with the transfer ball 20.

Figure 2:
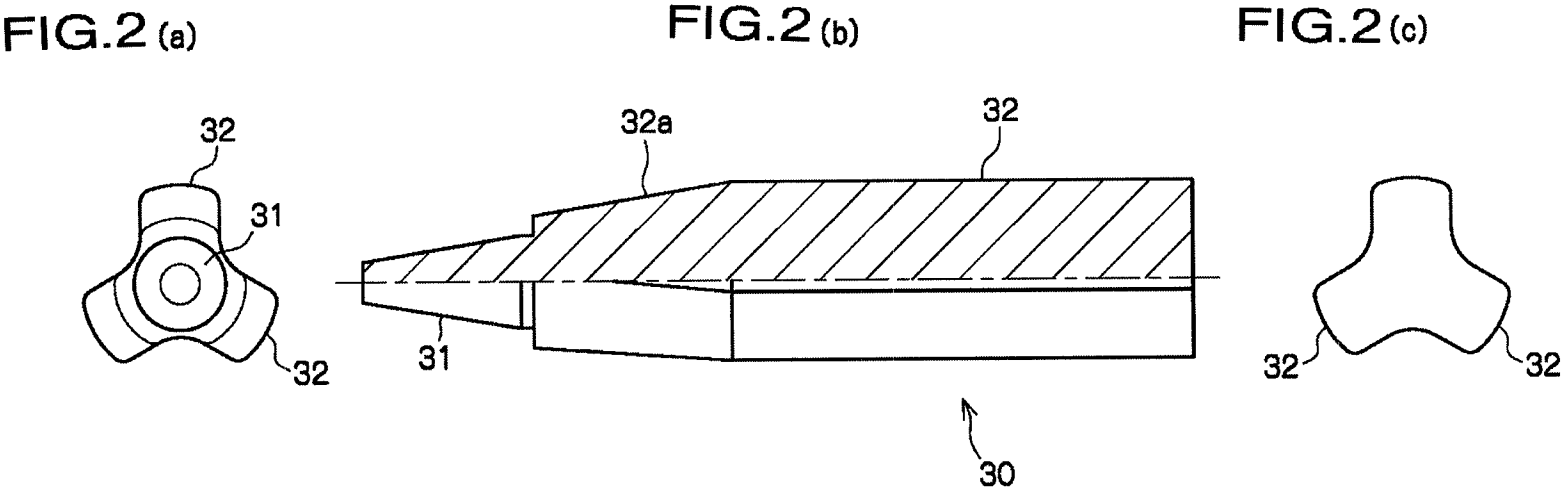

A plurality of (in the illustrated example, three) supporting protrusions 32 are provided to protrude in a substantially radial shape as shown in FIGS. 2A to 2C. The plurality of supporting protrusions 32 are pressure-welded to the inner peripheral surface of the chip body 10 when, in a manufacturing stage of the ballpoint pen chip 1, the receiving member 30 is inserted into the chip body 10, from the backward side of the chip body 10.

In FIGS. 2A to 2C, reference sign 32*a* denotes tapered surfaces for facilitating the insertion work. The tapered surfaces 32*a* are formed on the front end side of the supporting protrusions 32.

A space between the supporting protrusions 32 adjacent to each other in the circumferential direction functions as an ink flow path.

A writing utensil 100 equipped with the ballpoint pen chip 1 having the configuration explained above is explained (see FIG. 7).

The writing utensil 100 is a retractable ballpoint pen that protrudes the ballpoint pen chip 1 at the front end of a ballpoint pen refill 120 from the front end of a shaft cylinder 110 according to pressing operation of a knock section 140 and releasing the protruded state according to operation for deflecting a clip 111 to the shaft cylinder center side.

In the ballpoint pen refill 120, the ballpoint pen chip 1 is connected to the front end of an ink housing tube 121. Ink is filled in inner parts of the ink housing tube 121 and the ballpoint pen chip 1.

Action and effects during writing by the ballpoint pen chip 1 and the writing utensil 100 (the ballpoint pen) having the configuration explained above are explained.

As shown in FIG. 8, when a backward pressing force is applied to the transfer ball 20 by, for example, pressing the front end side of the transfer ball 20 against a written surface, the receiving member 30 elastically contracts in the axial direction. The transfer ball 20 slightly retreats. Therefore, a gap is formed between the transfer ball 20 and the inward annular protrusion 11*a*1. The ink is discharged from the gap. When the pressing force decreases, the receiving member 30 is restored to original length, the transfer ball 20 advances, and the gap is narrowed.

Therefore, when the pressing force is relatively large, a contraction amount of the receiving member 30 and a retreat amount of the transfer ball 20 increase. The gap between the transfer ball 20 and the inward annular protrusion 11*a*1 widens. Therefore, an ink discharge amount increases and a writing line becomes thick.

When the pressing force is relatively small, the contraction amount of the receiving member 30 and the retreat amount of the transfer ball 20 decrease. The gap between the transfer ball 20 and the inward annular protrusion 11*a*1 narrows. Therefore, the ink discharge amount decreases and the writing line becomes thin.

When writing is performed in a normal writing posture, the front end side of the receiving member 30 sometimes receives a pressing force in a direction inclining with respect to the direction of the center line of the receiving member 30 because of a writing angle and the like during the writing (see FIG. 8).

In the ballpoint pen chip 1 in this embodiment, the front end side of the receiving member 30 includes the reduction part 31, a cross-sectional area of which is gradually reduced forward. Therefore, even when the pressing force in the inclining direction is received as explained above, the front end side of the receiving member 30 less easily deflects in the radial direction and elastically contracts in the axial direction.

That is, if the front end side of the receiving member 30 is formed in a straight bar shape, it is likely that the front end side portion deflects in the radial direction and shifts from the center of the transfer ball 20, the retreat amount of the transfer ball 20 becomes unstable, and the ink discharge amount and the thickness of the writing line also become unstable. However, according to the present invention, it is possible to prevent such likelihood and stably obtain the writing line having a thickness corresponding to a pressing force.

Around the transfer ball 20, the gap s1 is secured by the internal corner portions 11*c* in the rectangular cylindrical inner wall surface 11*b*. Therefore, the gap s1 functions as an ink flow pass and maintains the ink flow rate stable.

Moreover, the outer peripheral surface of the transfer ball 20 is in point contact with the flat surface configuring the rectangular cylindrical inner wall surface 11*b*. Therefore, compared with, for example, the conventional technique for setting the outer peripheral surface of the transfer ball in contact with the cylindrical surface, it is possible to reduce rotation resistance of the transfer ball 20.

Another example of the ballpoint pen chip according to the present invention is explained.

Note that, in a ballpoint pen chip explained below, a portion of the ballpoint pen chip 1 explained above is changed. Therefore, the changed portion is mainly explained in detail. Redundant detailed explanation is omitted.

Second Embodiment

A ballpoint pen chip 2 shown in FIG. 9 has a configuration in which a coil spring 40 is added to the ballpoint pen chip 1.

Specifically, in the ballpoint pen chip 2, the coil spring 40 is annularly disposed around the reduction part 31 of the receiving member 30, a front end part of the coil spring 40 is brought in contact with the transfer ball 20, a rear end part of the coil spring 40 is unretreatably supported by a step part on the rear end side of the reduction part 31, and a gap s2 is secured between the rear end of the transfer ball 20 and the front end of the reduction part 31.

In the ballpoint pen chip 2 having the configuration, in a nonuse state in which a backward pressing force is not applied to the transfer ball 20, the transfer ball 20 is pressure-welded to the inward annular protrusion 11*a*1 by an elastic force of the coil spring 40. It is possible to effectively prevent an ink leak from between the transfer ball 20 and the inward annular protrusion 11*a*1.

When the transfer ball 20 is pressed against the written surface, the transfer ball 20 slightly retreats. Therefore, a gap is formed between the transfer ball 20 and the inward annular protrusion 11*a*1. The ink is discharged from the gap.

When a pressing force on the transfer ball 20 is relatively large, the rear end surface of the transfer ball 20 comes into contact with the front end surface of the receiving member 30 and the receiving member 30 elastically contracts. Therefore, the gap between the transfer ball 20 and the inward annular protrusion 11*a*1 increases, the ink flow rate due to the gap increases, and the writing line becomes thick. Note that, when the transfer ball 20 is formed of a synthetic resin material, in addition to the contraction of the receiving member 30, the transfer ball 20 also easily contracts. Therefore, it is possible to further increase the ink flow rate.

Therefore, like the ballpoint pen chip 1, it is possible to use the ballpoint pen chip 2 as a component of the writing utensil 100 (the ballpoint pen). In writing, it is possible to stably obtain a writing line having a thickness corresponding to a pressing force.

Third Embodiment

In a ballpoint pen chip 3 shown in FIG. 10, the receiving member 30 of the ballpoint pen chip 1 is replaced with a receiving member 50.

In the receiving member 50, two members, that is, a front side member 51 including a reduction part 51*a* and a rear side member 52 including supporting protrusions 52*b* are brought in contact in the front-rear direction.

The front side member 51 includes, in a front end side thereof, the reduction part 51*a* having a truncated cone shape substantially the same as the shape of the reduction part 31. A front-most end part of the reduction part 51*a* is brought in contact with the rear end of the transfer ball 20.

In the front side member 51, a plurality of (in an illustrated example, three) longitudinal ribs 51*b* extending in the front-rear direction are disposed at equal intervals in the circumferential direction in an outer peripheral part of a shaft-like portion further on the rear side than the reduction part 51*a*.

Further on the rear side than the reduction part 51*a* in the front side member 51, the longitudinal ribs 51*b* are formed to continue in the front-rear direction in a state in which the longitudinal ribs 51*b* are loosely fit in the inner peripheral surface of the chip body 10. Tapered surfaces 51*b*1 inclining to a shaft core side are formed on the front end side of the longitudinal rib 51*b*.

Figure 11A:
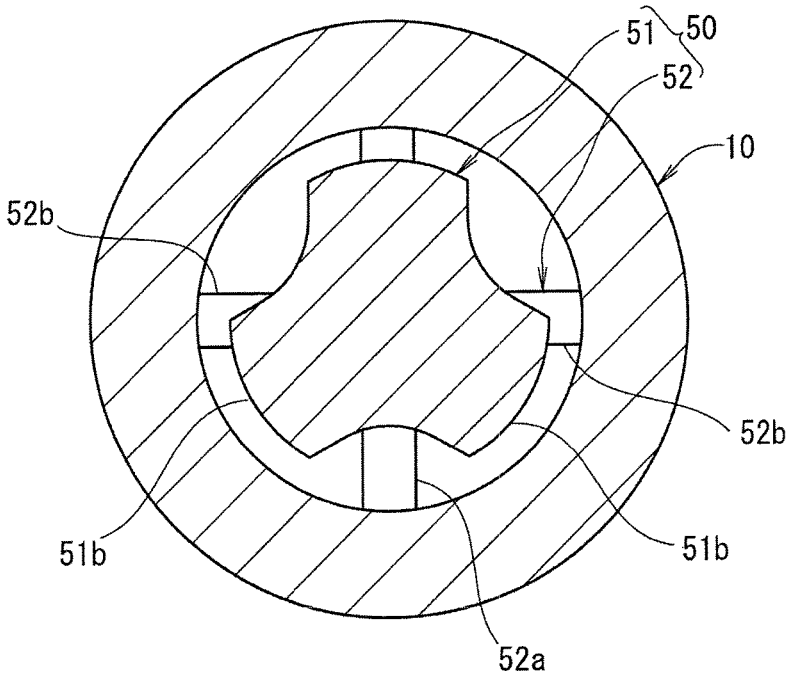
FIG. 11A is a sectional view taken along line (a)-(a) in FIG. 10.
Figure 11B:
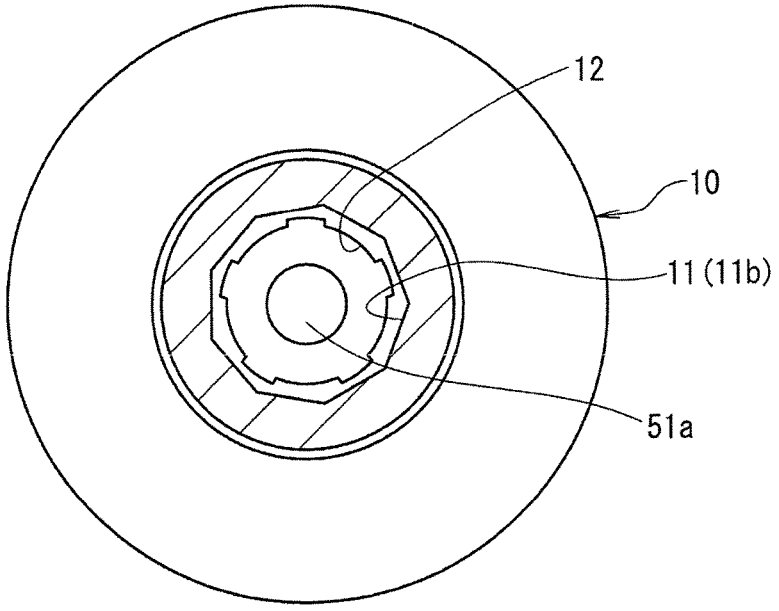
FIG. 11B is a sectional view taken along line (b)-(b) in FIG. 10.
Figure 12:
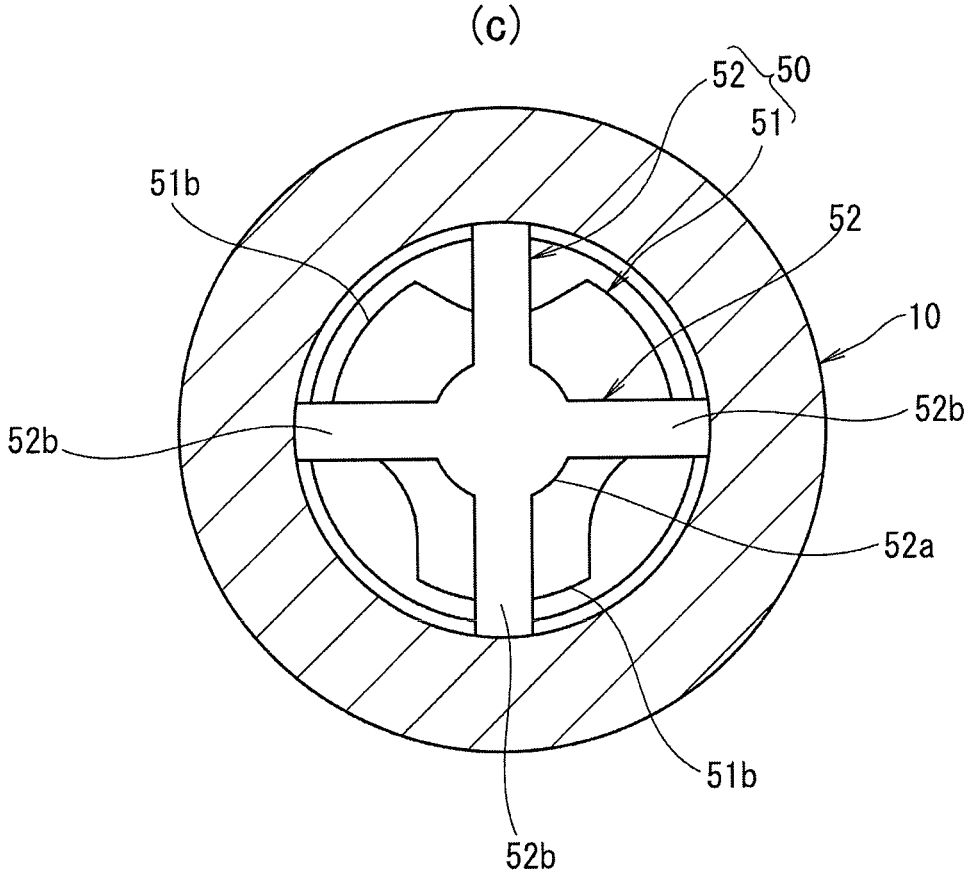
FIG. 12 is a sectional view taken along line (c)-(c) in FIG. 10.
Figure 13:
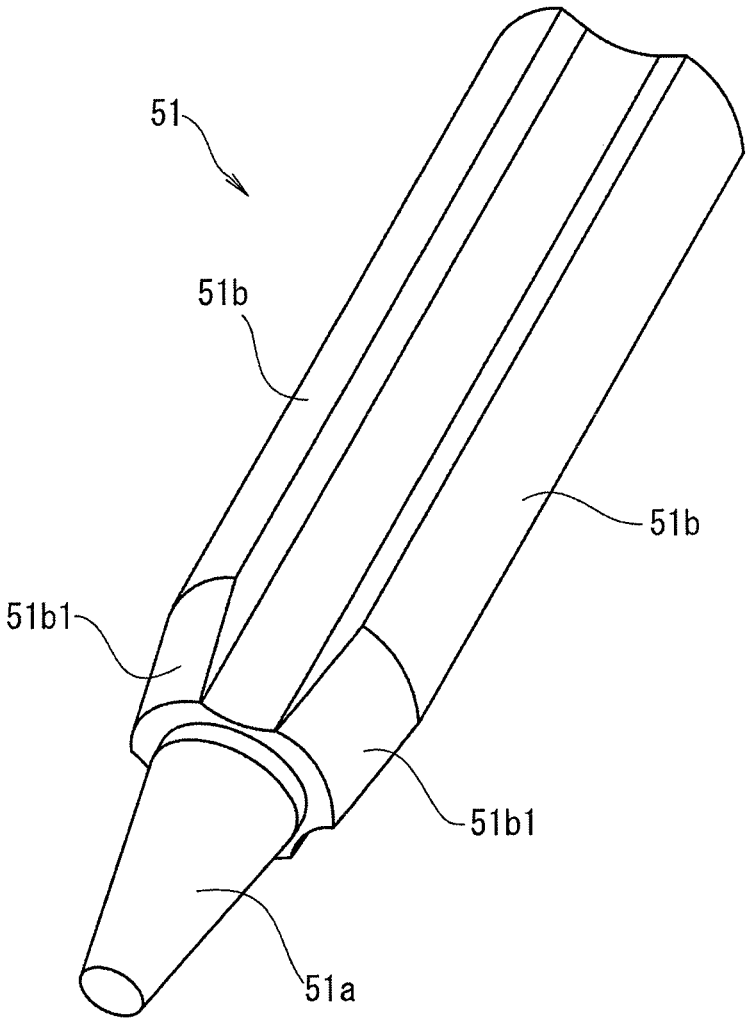
FIG. 13 is a perspective view showing a front side member of a receiving member in the third embodiment.

Note that, in FIGS. 10 to 12, a gap is shown between the longitudinal ribs 51*b* and the inner peripheral surface of the chip body 10. However, actually, the longitudinal ribs 51*b* are formed to be in contact, or in proximity, with the inner peripheral surface of the chip body 10 to loosely fit in the inner peripheral surface. With this configuration, it is possible to facilitate work for inserting the front side member 51 into the chip body 10. Moreover, it is possible to improve elastic flexibility in the axial direction of the entire front side member 51.

The longitudinal ribs 51*b* function as reinforcing ribs that suppress the front side member 51 from deflecting with writing pressure or the like.

The tapered surfaces 51*b*1 function as guide surfaces in inserting the receiving member 50 into the chip body 10.

A cylindrical jig insertion hole 51*c* opened backward is provided on the rear end side of the center part in the front side member 51.

Figure 14:
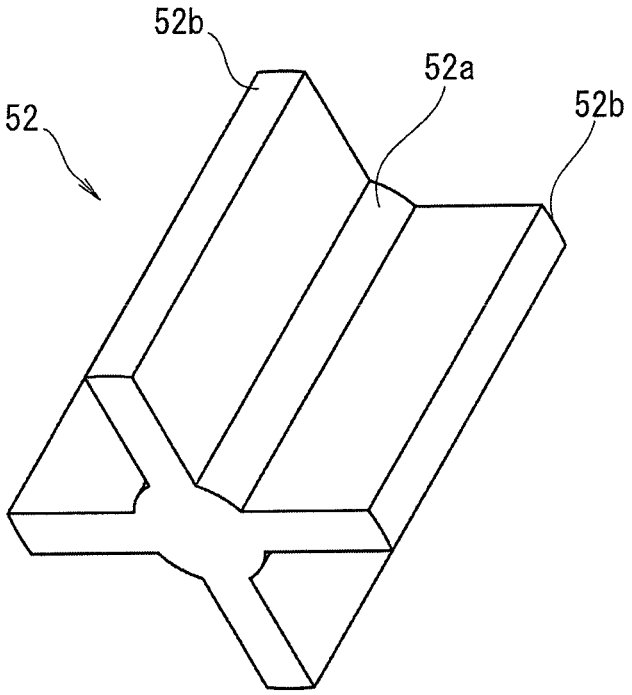
FIG. 14 is a perspective view showing a rear side member of the receiving member in the third embodiment.

As shown in FIG. 14, the rear side member 52 includes, in the outer circumference of a columnar shaft section 52*a*, a plurality of (in an illustrated example, four) supporting protrusions 52*b* protruding in the radial outer direction at equal intervals in the circumferential direction. The rear side member 52 receives the rear end surface of the front side member 51 and is fixed to be incapable of advancing and retreating by pressure-welding the plurality of supporting protrusions 52*b* to the inner wall surface of the chip body 10 in the front-rear direction.

The number of the supporting protrusions 52*b* of the rear side member 52 is set to be larger than the number of the longitudinal ribs 51*b* of the front side member 51 (see FIG. 12).

The front side member 51 having the configuration explained above is formed of a material more easily elastically deformed than the rear side member 52. The rear side member 52 is formed of a material having wear resistance higher than the wear resistance of the front side member 51.

In a preferred example of this embodiment, the front side member 51 is formed of polyethylene resin (PE) and the rear side member 52 is formed of polyacetal resin (POM).

As the PE, PE having a modulus of elasticity (a coefficient of elasticity) of 4 to 17[10^3 kg/cm^2], a coefficient of friction of 0.3 to 0.5, and hardness of HDD 45 to 75 can be used.

As the POM, POM having a modulus of elasticity of 24 to 31[10^3 kg/cm^2], a coefficient of friction of approximately 0.18, and hardness of approximately HRR 118 can be used.

A procedure for assembling the transfer ball 20 and the receiving member 50 in the chip body 10 in the ballpoint pen chip 3 shown in FIG. 10 is explained in detail.

First, the transfer ball 20 is inserted into the chip body 10 from the front and the front end side of the peripheral wall of the ball house 11 is caulked to form an inward annular protrusion 11*a*1.

Subsequently, the front side member 51 is inserted into the chip body 10 from the rear. The front end surface of the front side member 51 (specifically, the reduction part 51*a*) comes into contact with the rear end part of the transfer ball 20.

Note that, as an example, work for inserting the front side member 51 into the chip body 10 is performed by inserting a bar-like jig (not shown in the figure) into the jig insertion hole 51*c* of the front side member 51. The jig is pulled out after the inserting work. As another example, it is also possible to insert the front side member 51 into the chip body 10 without using the jig insertion hole 51*c* and the jig.

Subsequently, the rear side member 52 is pressed into the chip body 10 from the rear. The pressed-in rear side member 52 brings the front end part into contact with the rear end part of the front side member 51. Therefore, the front side member 51 is held by the transfer ball 20 and the rear side member 52 from the front-rear direction.

A pressing force in the press-in is set as appropriate such that the transfer ball 20 is pushed by the receiving member 50 and pressed against the inward annular protrusion 11*a*1 and an ink leak is prevented, the transfer ball 20 smoothly rotates, and it is possible to easily perform writing with an appropriate and proper writing pressure.

Therefore, like the ballpoint pen chip 1, the ballpoint pen chip 3 having the configuration explained above can be used as a component of the writing utensil 100 (the ballpoint pen). In writing, it is possible to stably obtain a writing line having a thickness corresponding to a pressing force.

Moreover, the rear side member 52 is formed of the material having the wear resistance higher than the wear resistance of the front side member 51. Therefore, when the rear side member 52 is pressed into the chip body 10, the supporting protrusions 52*b* of the rear side member 52 are less easily shaved. Consequently, it is possible to prevent foreign matters such as chips from remaining in the chip body 10, stabilize a fitting force of the receiving member 50 and the chip body 10 to prevent the fitting force from decreasing, and improve workability in the press-in.

The front side member 51 is formed of the material more easily elastically deformed than the rear side member 52. Therefore, it is possible to effectively contract portions of the front side member 51, in particular, the reduction part 51*a* with a writing pressure, and facilitate line width adjustment by writing pressure adjustment.

In the ballpoint pen chip 3, the number of the longitudinal ribs 51*b* of the receiving member 50 and the number of the supporting protrusions 52*b* of the rear side member 52 are differentiated to reduce the resistance of the ink flow path.

The front side member 51 is likely to rotate in assembly work or the like. If the numbers of the longitudinal ribs 51*b* and the supporting protrusions 52*b* are set the same, when the rear end parts of the longitudinal ribs 51*b* are located forward between the supporting protrusions 52*b* adjacent to each other, the ink flowing forward receives large resistance from the rear end surfaces of the longitudinal ribs 51*b*.

However, in the ballpoint pen chip 3 in this embodiment, as shown in FIG. 12, it is easy to secure a portion where the longitudinal ribs 51*b* adjacent to each other communicate in the axial direction and the supporting protrusions 52*b* adjacent to each other communicate in the axial direction. Therefore, it is possible to reduce ink flow resistance.

Fourth Embodiment

In a ballpoint pen chip 4 shown in FIG. 15, the receiving member 30 of the ballpoint pen chip 1 explained above is replaced with a receiving member 60.

The receiving member 60 is integrally configured from two members, that is, a front side member 61 including a reduction part 61*a* and a rear side member 62 including supporting protrusions 62*a*.

The front side member 61 is formed from only the reduction part 61*a* having a shape substantially the same as the shape of the reduction part 31 (see FIG. 1) in the ballpoint pen chip 1.

The rear side member 62 is formed in a shape substantially the same as the portion further on the rear side than the reduction part 31 in the ballpoint pen chip 1. The rear side member 62 includes a plurality of (in an illustrated example, three) supporting protrusions 62*a* provided at equal intervals in the circumferential direction.

The front side member 61 is formed of a material (PE) same as the material of the front side member 51 of the ballpoint pen chip 3. The rear side member 62 is formed of a material (POM) same as the material of the rear side member 52 of the ballpoint pen chip 3.

That is, the front side member 61 is formed of a material more easily elastically deformed than the rear side member 62. The rear side member 62 is formed of a material having wear resistance higher than the wear resistance of the front side member 61.

The front side member 61 and the rear side member 62 are integrally coupled by two-color molding (double molding) to configure the receiving member 60.

Note that, as another example, it is also possible to provide a recessed part in the front end part of the rear side member 62 and fit or screw the front side member 61 in the recessed part.

Note that, in FIG. 15, reference sign 62*a*1 denotes a tapered surface for facilitating inserting work into the chip body 10.

Reference sign 62*c* denotes a jig insertion hole for inserting a jig. The jig insertion hole 62*c* is used according to necessity.

A manufacturing procedure of the ballpoint pen chip 4 is explained. The transfer ball 20 is inserted into the front end side of the chip body 10, the front end side of the chip body 10 is caulked, and, thereafter, the receiving member 60 is pressed into the chip body 10 from the backward side. This work is performed by inserting a bar-like jig (not shown in the figure) into the jig insertion hole 62*c* on the rear end side of the receiving member 60.

A pressing force in the press-in is set as appropriate such that the transfer ball 20 is pushed by the receiving member 60 and pressed against the inward annular protrusion 11*a*1 and an ink leak is prevented, the transfer ball 20 smoothly rotates, and it is possible to easily perform writing with an appropriate and proper writing pressure.

Therefore, like the ballpoint pen chip 1, the ballpoint pen chip 4 having the configuration explained above can be used as a component of the writing utensil 100 (the ballpoint pen). In writing, it is possible to stably obtain a writing line having a thickness corresponding to a pressing force.

Moreover, the rear side member 62 is formed of the material having the wear resistance higher than the wear resistance of the front side member 61. Therefore, when the rear side member 62 is pressed into the chip body 10, supporting protrusions 62*a* of the rear side member 62 are less easily shaved. Consequently, it is possible to prevent foreign matters such as chips from remaining in the chip body 10 and improve workability in the press-in.

The front side member 61 (the reduction part 61*a*) is formed of the material more easily elastically deformed than the rear side member 62. Therefore, it is possible to effectively contract the front side member 61 (the reduction part 61*a*) with a writing pressure. It is possible to facilitate line width adjustment by writing pressure adjustment.

Fifth Embodiment

Figure 18:
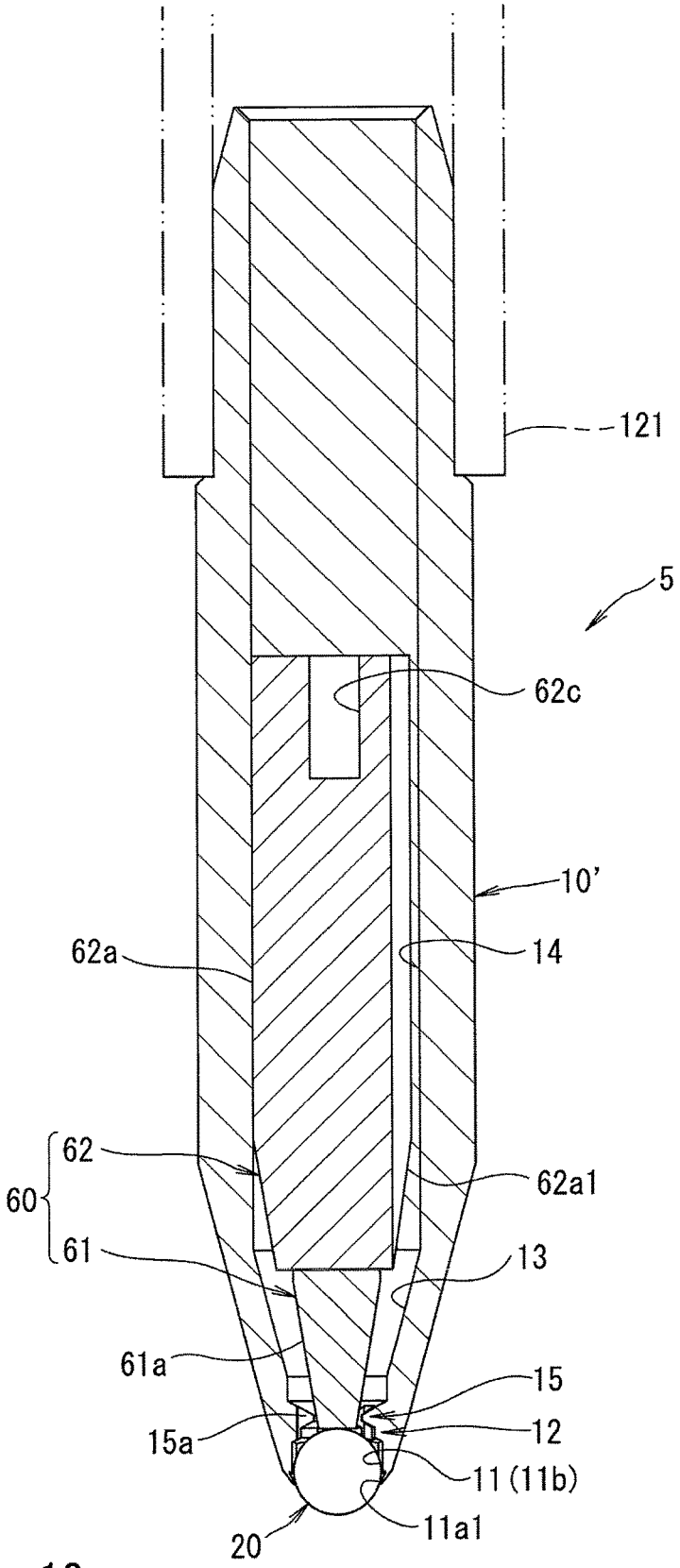
FIG. 18 is a longitudinal sectional view showing a fifth embodiment of the ballpoint pen chip according to the present invention.

In a ballpoint pen chip 5 shown in FIG. 18, the chip body 10 of the ballpoint pen chip 4 (see FIG. 15) explained above is replaced with a chip body 10'.

In the chip body 10', deflection suppressing protrusions 15 and ink guide grooves 15*b* are provided and the constricted part 12 is changed to a position closer to the front in the chip body 10 explained above.

Specifically, in the ball house 11 on the front end side in the chip body 10', the constricted part 12 reduced in diameter is provided to receive the retreated transfer ball 20 on the front end surface 12*b* (see FIG. 20).

The chip body 10' includes, on the inner wall further on the backward side than the front end surface 12*b* of the constricted part 12, the deflection suppressing protrusions 15 that suppress deflection in the radial direction of the reduction part 61*a*.

The front end surface 12*b* of the constricted part 12 is a substantially mortar shape inclining backward toward the center part.

Front and rear positions of the constricted part 12 are set such that in a state in which the retreated transfer ball 20 is received, the transfer ball 20 protrudes forward by a dimension P from the front end of the chip body 10'.

The dimension P is set such that, when the front end side outer peripheral surface of the transfer ball 20 is brought in contact with the written surface and writing is performed at a normal writing angle (60 to 90 degrees), the front end edge of the chip body 10' less easily rubs against the written surface, friction between the written surface and the front end edge of the chip body 10' decreases, and smooth writing is performed.

A plurality of deflection suppressing protrusions 15 are provided around the reduction part 61*a* at a predetermined interval in the circumferential direction. Portions between the deflection suppressing protrusions 15 adjacent to one another in circumferential direction constitute ink guide groves 15*b* continuous in the front-rear direction.

The deflection suppressing protrusions 15 are reduced in diameter stepwise with respect to the inner diameter of the constricted part 12.

Positions of front end surfaces 15*a* of the deflection suppressing protrusions 15 are set as appropriate such that, as indicated by an alternate long and two short dashes line in FIG. 20, when the transfer ball 20 retreats and comes into contact with the front end surface 12*b* (specifically, a corner part) of the constricted part 12 with a pressing force from the front, an ink reservoir space s3 is secured between a rear side portion of the retreated transfer ball 20 and the front end surfaces 15*a* of the deflection suppressing protrusions 15.

As shown in FIG. 20, the deflection suppressing protrusions 15 include the front end surfaces 15*a* inclining backward toward the center part and rear end surfaces 15*c* inclining forward toward the center part. Protruded end surfaces 15*d* protruding in the radial inner direction are in proximity or in contact with the outer peripheral surface of the reduction part 61*a*.

Dimensions of the protruded end surfaces 15*d* are set such that the protruded end surfaces 15*d* are in proximity with the outer peripheral surface of the reduction part 61*a* without being in contact with the outer peripheral surface. However, depending on dimension fluctuation, inclination involved in manufacturing, or the like, of the receiving member 60, the protruded end surfaces 15*d* are sometimes in contact with the reduction part 61*a*.

A plurality of ink guide grooves 15*b* are disposed at a predetermined interval in the circumferential direction on the inner peripheral sides of the deflection suppressing protrusions 15 and the constricted part 12. The ink guide grooves 15*b* continue in the front-rear direction to pierce through the deflection suppressing protrusions 15 and the constricted part 12. The bottom parts (the inner surfaces in the radial outer direction) of the ink guide grooves 15*b* are located further on the radial outer direction side than the inner diameter of the constricted part 12 (see FIG. 19).

The ink guide grooves 15*b* circulate the ink further on the rear side than the deflection suppressing protrusions 15 further to the front side than the deflection suppressing protrusions 15 and the constricted part 12.

Figure 21A:
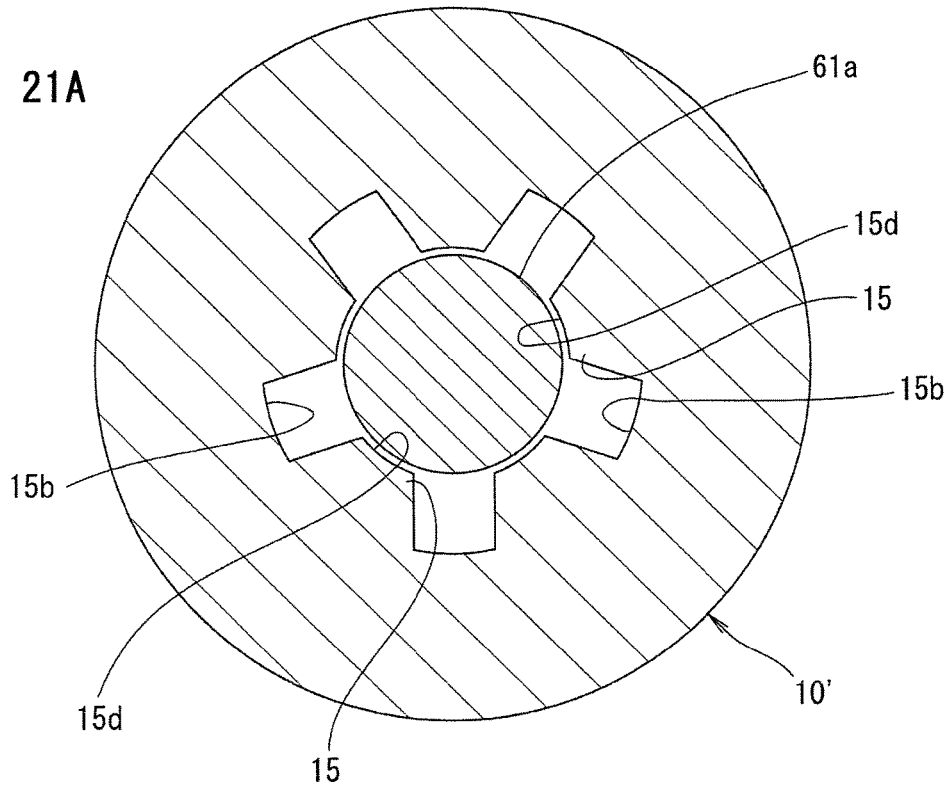
Figure 21B:
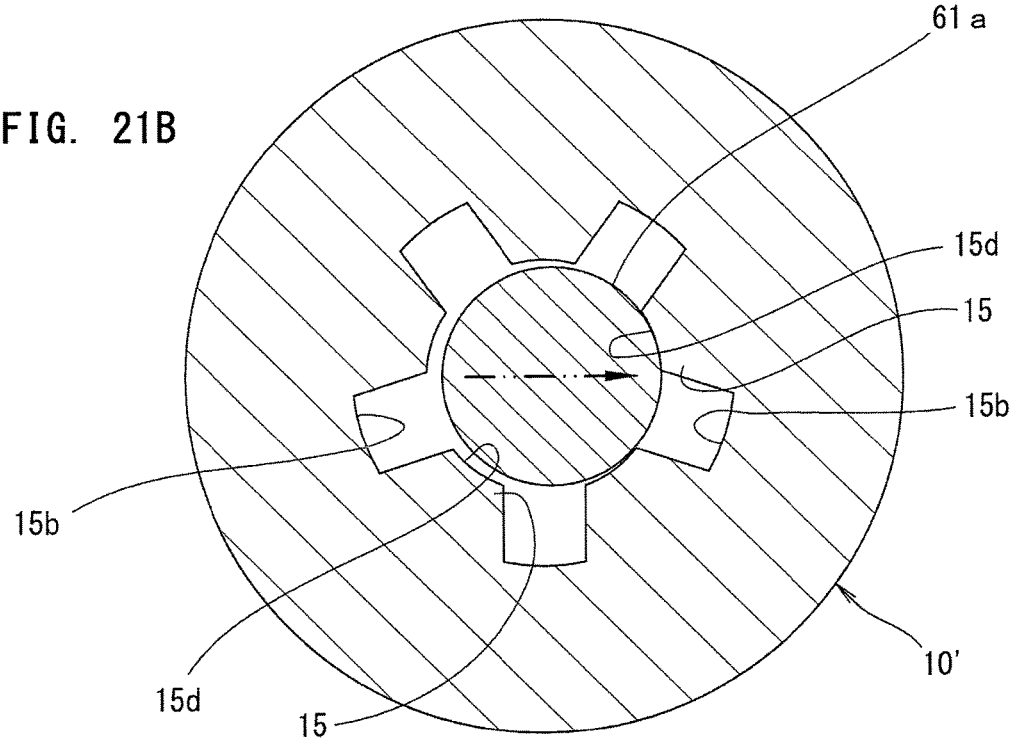

Therefore, in the ballpoint pen chip 5, as shown in FIGS. 20 to 21B, in an initial state, the transfer ball 20 is separated forward from the constricted part 12. The rear end part of the transfer ball 20 is in proximity or in contact with the front end part of the reduction part 61*a*.

In this state, when a relatively strong pressing force in the backward direction is applied to the transfer ball 20 and the reduction part 61*a* is about to deflect in the radial direction with the pressing force, the outer peripheral surface of the reduction part 61*a* is received by the inner peripheral surfaces of the deflection suppressing protrusions 15 and deflection of the reduction part 61*a* is suppressed.

Therefore, the reduction part 61*a* hardly deflects in the radial direction and elastically contracts backward. Therefore, it is possible to prevent a situation in which an ink blur occurs in writing in a specific direction and a line width becomes unstable because of the deflection.

That is, it is possible to prevent a situation in which the gap between the protruded end surfaces 15*d* and the reduction part 61*a* contains irregularities and an ink flow rates becomes unstable because of the deflection. It is possible to eliminate deficiencies due to such a phenomenon.

Moreover, according to a preferred example of this embodiment, the ink guide grooves 15*b* extending over the deflection suppressing protrusions 15 and the constricted part 12 are provided. Further, the ink reservoir space s3 is secured further on the front side than the front end surfaces 15*a*. Therefore, it is possible to stably secure an ink flow rate. In particular, even when a strong writing pressure is applied and the transfer ball 20 relatively largely retreats, the flow path and the reservoir space of the ink are not lost. It is possible to write a thick line corresponding to the writing pressure.

Further, as indicated by an alternate long and two short dashes line in FIG. 20, even when the retreat amount of the transfer ball 20 is relatively large because of a stronger pressing force, the transfer ball 20 is received by the constricted part 12. The front end side of the transfer ball 20 in the retreated state is located further forward than the front end of the chip body 10'. Therefore, it is possible to prevent a situation in which, for example, the front end edge of the chip body 10' rubs against the written surface and writing becomes impossible.

Other Modifications

Note that, in the embodiments, a positional relation between the ink guide grooves 12*a* (see FIG. 5) of the constricted part 12 and the internal corner portions 11*c* of the rectangular cylindrical inner wall surface 11*b* is not particularly limited. However, as a form for reducing the flow resistance of the ink, the plurality of ink guide grooves 12*a* may be disposed to respectively correspond to the internal corner portions 11*c*.

In the ballpoint pen chip 2 shown in FIG. 9, the gap s2 is provided between the front end of the receiving member 30 and the rear end of the transfer ball 20. However, as another example, it is possible to omit the gap s2 and set the front end of the receiving member 30 in contact with the rear end of the transfer ball 20.

In the illustrated example, as the particularly preferred form, the rectangular cylindrical inner wall surface 11*b* (see FIG. 3) is provided in the ball house 11. However, as another example, it is also possible to provide an inner wall surface having a shape other than the illustrated shape such as a cylindrical inner wall surface instead of the rectangular cylindrical inner wall surface 11*b*. In the other example, it is possible to extend and contract the receiving member 30 (50 or 60) and advance and retreat the transfer ball 20 with a pressing force from the front to obtain a writing line having a line width corresponding to the pressing force.

According to the illustrated example, the rectangular cylindrical inner wall surface 11*b* (see FIG. 3) is provided in the ball house 11 in the ballpoint pen chip 1 (2, 3, or 4) enabled to adjust a line width with the receiving member 30 or the like. However, the rectangular cylindrical inner wall surface 11*b* can be applied to the inner wall surface of a ball house in, for example, a ballpoint pen chip not including the receiving member 30 (50 or 60) and a ballpoint pen chip including a coil spring for elastically urging the transfer ball 20 instead of the receiving member 30 (50 or 60). Even in such a case, it is possible to secure a stable ink flow rate with the gap s1 on the inner side of the internal corner portion 11*c* in the rectangular cylindrical inner wall surface 11*b*.

In the ballpoint pen chip 1 (2, 3, or 4), as the particularly preferred form, the receiving member 30 (50 or 60) is formed of the elastically deformable hard synthetic resin material. However, as another example, a part or the entire receiving member 30 (50 or 60) can also be formed of a metal material (as a specific example, stainless steel, brass, etc.). In such a case, it is desirable to form the transfer ball 20 from the elastically deformable synthetic resin material.

In the illustrated example, as an example of the writing utensil 100 equipped with the ballpoint pen chip 1, a single-color ballpoint pen is configured. However, as another example of the writing utensil 100, it is also possible to configure a multi-color writing utensil equipped with a plurality of colors of ballpoint pen refills and a multifunction writing utensil equipped with a plurality of kinds of refills such as a ballpoint pen refill and a mechanical pencil refill. Note that it goes without saying that the writing utensil 100 can be configured in the same manner concerning the ballpoint pen chips 2, 3, and 4.

In the ballpoint pen chip 3 (see FIG. 10), the front side member 51 and the rear side members 52 separate from each other are brought in contact with each other. However, as another example, the front side member 51 and the rear side member 52 can be integrated by fitting or screwing or can be integrated by double molding.

In the ballpoint pen chip 4 (see FIG. 15), the front side member 61 and the rear side member 62 are integrally coupled. However, as another example, it is also possible to provide a recessed part at the front end of the rear side member 62 and fit the front side member 61 in the recessed part to be capable of advancing and retreating.

In the illustrated example, the coil spring 40 is provided only in the ballpoint pen chip 2. However, it is also possible to apply substantially the same structure to the ballpoint pen chip 3 and the ballpoint pen chip 4 and provide the coil spring 40 therein.

In the ballpoint pen chips 1 and 4 (see FIGS. 1 and 15), the receiving member 30 (or 60) is fit in the chip body 10 to be incapable of advancing and retreating. However, as another example, it is also possible to engage the receiving member 30 (or 60) with the chip body 10 to be untreatable and capable of advancing. In this case, forward movement of the receiving member 30 (or 60) is restricted by contact with the transfer ball 20.

In the ballpoint pen chip 5 (FIGS. 18 to 21B), the dimensions are set such that the deflection suppressing protrusions 15 are not in contact with and are in proximity with the sidewall of the reduction part 61*a*. However, as another example, it is also possible to set the dimensions such that the deflection suppressing protrusions 15 are in contact with the sidewall of the reduction part 61*a* such that the reduction part 61*a* rubs against the deflection suppressing protrusions 15 and contracts with a backward pressing force.

In the ballpoint pen chip 5 (FIGS. 18 to 21B), the deflection suppressing protrusions 15 are added to the ballpoint pen chip 4 (see FIG. 15). However, as another example, it is also possible to add the deflection suppressing protrusions 15 to the ballpoint pen chip 1 (FIG. 1), the ballpoint pen chip 2 (FIG. 9), or the ballpoint pen chip 3 (FIG. 10).

The present invention is not limited to the embodiments explained above and can be changed as appropriate without changing the gist of the present invention.

REFERENCE SIGNS LIST

1, 2, 3, 4, 5 Ballpoint pen chip
10, 10' Chip body
11 Ball house
11*a* Cylindrical inner peripheral surface
11*a*1 Inward annular protrusion
11*b* Rectangular cylindrical inner wall surface
12 Constricted part
15 Deflection suppressing protrusion
15*a* Front end surface
15*b* Ink guide groove
15*c* Rear end surface
15*d* Protruded end surface
20 Transfer ball
30, 50, 60 Receiving member
31, 51*a*, 61*a* Reduction part
32, 52*b*, 62*a* Supporting protrusion
51, 61 Front side member
52, 62 Rear side member
100 Writing utensil (ballpoint pen)
120 Ballpoint pen refill
s1, s2 Gap
S3 Ink reservoir space

What is claimed is:

1. A ballpoint pen chip comprising:

a substantially cylindrical chip body having an inner part pierced through in a front-rear direction;

a transfer ball housed on a front end side in said chip body, an outer peripheral surface front end side of said transfer ball being protruded forward from said chip body; and a receiving member disposed further on a backward side than said transfer ball in said chip body, a rear half part side of said transfer ball being received by a front end part of said receiving member, wherein said receiving member includes, on a front end side thereof, a reduction part gradually reduced in a cross-sectional area forward, a front-most end part of said reduction part is disposed backward from said transfer ball, and a portion of the receiving member further on a rear side than said reduction part is formed to be solid, in an integral bar shape and unretreatably fixed to said chip body and configured to elastically contract when a pressing force is received from said transfer ball.

2. The ballpoint pen chip according to claim 1, wherein said reduction part is formed to be solid and shaped such that said cross-sectional area of said reduction part is continuously enlarged backward from said front-most end part of said receiving member.

3. The ballpoint pen chip according to claim 1, wherein said receiving member includes, further on a rear side than said reduction part, a plurality of supporting protrusions which protrude in a radial outer direction at intervals in a circumferential direction, and said supporting protrusions are pressure-welded to an inner wall surface of said chip body so as to be unretreatably fixed thereto.

4. The ballpoint pen chip according to claim 3, wherein said receiving member is configured from two members, that is, a front side member including said reduction part and a rear side member including said supporting protrusions.

5. The ballpoint pen chip according to claim 4, wherein said rear side member is formed of a material having wear resistance higher than the wear resistance of said front side member.

6. The ballpoint pen chip according to claim 4, wherein said front side member is formed of a material that is more easily elastically deformed than said rear side member.

7. The ballpoint pen chip according to claim 4, wherein said front side member is provided between said transfer ball and said rear side member in a state in which said front side member is loosely fit on an inner peripheral surface of said chip body.

8. The ballpoint pen chip according to claim 4, wherein a plurality of longitudinal ribs extending in the front-rear direction are provided at intervals in a circumferential direction in an outer peripheral part further on a rear side than said reduction part, and a number of said longitudinal ribs and a number of said supporting protrusions are different.

9. The ballpoint pen chip according to claim 4, wherein said front side member and said rear side member are coupled and integrated.

10. The ballpoint pen chip according to claim 1, wherein said receiving member is integrally formed from one kind of a synthetic resin material.

11. The ballpoint pen chip according to claim 1, wherein a deflection suppressing protrusion that suppresses deflection of said reduction part while being in proximity or in contact with a sidewall of said reduction part is provided on an inner wall of said chip body.

12. The ballpoint pen chip according to claim 11, wherein a plurality of said deflection suppressing protrusions are provided at intervals in the circumferential direction, and respective spaces between said deflection suppressing protrusions adjacent to each other in the circumferential direction constitute an ink guide groove communicating in the front-rear direction.

13. The ballpoint pen chip according to claim 11, wherein a constricted part that receives said transfer ball on a front end surface when said transfer ball retreats is provided on a front end side in said chip body, and said deflection suppressing protrusion is disposed further on a backward side than said front end surface of said constricted part.

14. The ballpoint pen chip according to claim 13, wherein front and rear positions of said constricted part are set such that said received transfer ball protrudes forward from a front end of said chip body.

15. The ballpoint pen chip according to claim 1, wherein a coil spring is disposed annularly around said reduction part, and a front end part of said coil spring is brought in contact with said transfer ball and a rear end part of said coil spring is unretreatably supported.

16. The ballpoint pen chip according to claim 1, wherein a rectangular cylindrical inner wall surface is formed on a front end side in said chip body, and said rectangular cylindrical inner wall surface is in proximity or in contact with an outer peripheral surface of said transfer ball.

17. A writing utensil comprising the ballpoint pen chip according to claim 1.

18. A ballpoint pen chip comprising:

a substantially cylindrical chip body having an inner part pierced through in a front-rear direction;

a transfer ball housed on a front end side in said chip body, an outer peripheral surface front end side of said transfer ball being protruded forward from said chip body;

a receiving member disposed further on a backward side than said transfer ball in said chip body;

a rear half part side of said transfer ball being received by a front end part of said receiving member;

said receiving member including, on a front end side thereof, a reduction part gradually reduced in a cross-sectional area forward;

a front-most end part of said reduction part being disposed backward from said transfer ball;

a portion of the receiving member further on a rear side than said reduction part being unretreatably fixed to said chip body and configured to elastically contract when a pressing force is received from said transfer ball;

said receiving member including, further on a rear side than said reduction part, a plurality of supporting protrusions which protrude in a radial outer direction at intervals in a circumferential direction; and said supporting protrusions being pressure-welded to an inner wall surface of said chip body so as to be unretreatably fixed thereto.

19. A ballpoint pen chip comprising:

a substantially cylindrical chip body having an inner part pierced through in a front-rear direction;

a transfer ball housed on a front end side in said chip body, an outer peripheral surface front end side of said transfer ball being protruded forward from said chip body;

a receiving member disposed further on a backward side than said transfer ball in said chip body;

a rear half part side of said transfer ball being received by a front end part of said receiving member;

said receiving member including, on a front end side thereof, a reduction part gradually reduced in a cross-sectional area forward;

a front-most end part of said reduction part being disposed backward from said transfer ball;

a portion of the receiving member further on a rear side than said reduction part being unretreatably fixed to said chip body and configured to elastically contract when a pressing force is received from said transfer ball;

a deflection suppressing protrusion that suppresses deflection of said reduction part while being in proximity or in contact with a sidewall of said reduction part being provided on an inner wall of said chip body;

a plurality of said deflection suppressing protrusions being provided at intervals in the circumferential direction; and respective spaces between said deflection suppressing protrusions adjacent to each other in the circumferential direction constituting an ink guide groove communicating in the front-rear direction.

20. A ballpoint pen chip comprising:

a substantially cylindrical chip body having an inner part pierced through in a front-rear direction;

a transfer ball housed on a front end side in said chip body, an outer peripheral surface front end side of said transfer ball being protruded forward from said chip body;

a receiving member disposed further on a backward side than said transfer ball in said chip body;

a rear half part side of said transfer ball being received by a front end part of said receiving member;

said receiving member including, on a front end side thereof, a reduction part gradually reduced in a cross-sectional area forward;

a front-most end part of said reduction part being disposed backward from said transfer ball;

a portion of the receiving member further on a rear side than said reduction part being unretreatably fixed to said chip body and configured to elastically contract when a pressing force is received from said transfer ball;

a coil spring being disposed annularly around said reduction part; and a front end part of said coil spring being brought in contact with said transfer ball and a rear end part of said coil spring is unretreatably supported.

* * * * *